United States Patent [19]

Shimada et al.

[11] Patent Number: 4,883,746

[45] Date of Patent: Nov. 28, 1989

[54] SILVER HALIDE PHOTOGRAPHIC MATERIAL

[75] Inventors: Yasuhiro Shimada; Hiroshi Fukuzawa; Seiji Ichijima, all of Kanagawa, Japan

[73] Assignee: Fuji Photo Film Co., Ltd., Kanagawa, Japan

[21] Appl. No.: 309,925

[22] Filed: Feb. 13, 1989

Related U.S. Application Data

[63] Continuation of Ser. No. 868,389, May 29, 1986, abandoned.

[30] Foreign Application Priority Data

May 29, 1985 [JP] Japan ..... 60-114242

[51] Int. Cl.[4] ..... G03C 7/26; G03C 7/32

[52] U.S. Cl. ..... 430/504; 430/505; 430/549; 430/552; 430/553; 430/359

[58] Field of Search ..... 430/226, 549, 359, 553, 430/361, 552, 504, 505

[56] References Cited

U.S. PATENT DOCUMENTS

| | | | |
|---|---|---|---|
| 4,004,929 | 1/1977 | Orvis | 430/549 |
| 4,141,730 | 2/1979 | Minagawa et al. | 430/359 |
| 4,288,532 | 9/1981 | Seoka et al. | 430/553 |
| 4,294,900 | 10/1981 | Aono | 430/549 |
| 4,458,012 | 7/1984 | Ito et al. | 430/549 |
| 4,536,472 | 8/1985 | Kato et al. | 430/553 |
| 4,579,813 | 4/1986 | Aoki et al. | 430/505 |
| 4,647,527 | 3/1987 | Ikenoue et al. | 430/505 |
| 4,690,889 | 9/1987 | Saito et al. | 430/553 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A novel silver halide color photographic material is provided which comprises at least one colored coupler represented by the general formula (I) and at least one cyan coupler represented by the general formula (II), (III), (IV) or (V):

(I)

-continued (II)

(III)

(IV)

(V)

wherein $R_1$ represents an aromatic or heterocyclic group; $R_2$ represents a group capable of being substituted on a naphthol ring; $R_3$ represents an aliphatic, heterocyclic or aromatic group; $R_4$ represents an aromatic group excluding p-cyanophenyl group; $R_5$ represents an aromatic or heterocyclic group; $R_6$ represents an aliphatic group; n represents an integer of 0 to 4; m represents an integer of 0 to 3; A—B—N=N—D represents a group which is eliminated upon coupling; A represents a divalent group whose bond to the carbon atom at the coupling active position of the coupler is cleaved upon the reaction with an oxidation product of a color developing agent; B represents a divalent aromatic or heterocyclic group; D represents an aromatic or heterocyclic group; Y represents a hydrogen atom or a group which is eliminated upon coupling; and X represents —O—, —S— or in which $R_7$ represents a hydrogen atom or an organic substituent group, with the proviso that when n and m each represents a plural integer, $R_2$ may be the same as or different from each other or may be bonded to each other to form a ring. In the general formula (V), $R_2$ and X or X and Y may be bonded to each other to form a ring. $R_1$, $R_2$, $R_3$, $R_5$, $R_6$, $R_7$, X or Y may form a dimer or higher polymer. In the general formula (I), at least one of the groups represented by A, B and D has sulfo groups, carboxyl groups, or alkali metal or ammonium salts thereof as substituent groups.

20 Claims, No Drawings

SILVER HALIDE PHOTOGRAPHIC MATERIAL

This is a continuation of application Ser. No. 868,389, filed 5/29/86, now abandoned.

FIELD OF THE INVENTION

The present invention relates to a silver halide photographic material, which provides a high cyan image density, excellent in color image stability. More particularly, the present invention relates to a highly sensitive silver halide photographic material which provides a sufficiently high cyan color image density even when subjected to bleaching with a bleaching agent having a weak oxidizing power or a bleaching solution which has become exhausted.

BACKGROUND OF THE INVENTION

When a silver halide photographic material is color-developed after being exposed to light, a color developing agent such as an aromatic primary amine is oxidized, and the color developing agent thus oxidized reacts with a dye-forming coupler to form a color image. In general, the color reproduction in this method is accomplished by the subtractive process. In order to reproduce blue, green and red colors, images of yellow, magenta and cyan, which are complementary to these colors, respectively, are formed. As cyan dye-forming couplers, phenols or naphthols are often used.

Ideally speaking, a cyan image produced from a cyan coupler should absorb red light alone. In general, however, such a cyan image usually also absorbs some green light and blue light.

In order to avoid such side absorption, a masking process using a colored coupler has been put into practical use in the art.

U.S. Pat. No. 4,458,012 discloses a color photographic material which provides a cyan color image having an improved fastness. However, this color photographic material is disadvantageous in that when it comprises both a colored coupler and a cyan coupler, it cannot form a sufficiently high density cyan color image when a treatment process comprising a bleaching step using a bleaching agent having weak oxidizing power is employed.

In recent years, color photographic materials have been required to provide a higher sensitivity and picture quality. Furthermore, the excellent photographic properties such as high sensitivity and picture quality must be accomplished not only by using the best development process, but also by using a development process comprising various steps using various kinds of treatment solution or using the treatment solution exhausted due to running. More particularly, the desired color photographic materials must provide a sufficiently high density cyan color image even when subjected to bleaching with a bleaching agent having weak oxidizing power (e.g., contaminated Fe(III)-EDTA and persulfate solutions).

SUMMARY OF THE INVENTION

It is, therefore, an object of the present invention to provide a silver halide color photographic material which can provide a high sensitivity and picture quality and which can also provide a sufficiently high density cyan color image even when subjected to bleaching with a bleaching solution having weak oxidizing power or a bleaching solution which has become exhausted.

It is another object of the present invention to provide a silver halide color photographic material excellent in color image fastness.

It is a further object of the present invention to provide a silver halide color photographic material excellent in color reproduction.

These and other objects of the present invention will become more apparent from the following detailed description and examples.

These objects of the present invention are accomplished by a silver halide color photographic material comprising at least one colored coupler represented by the general formula (I) and at least one cyan coupler represented by the general formula (II), (III), (IV) or (V):

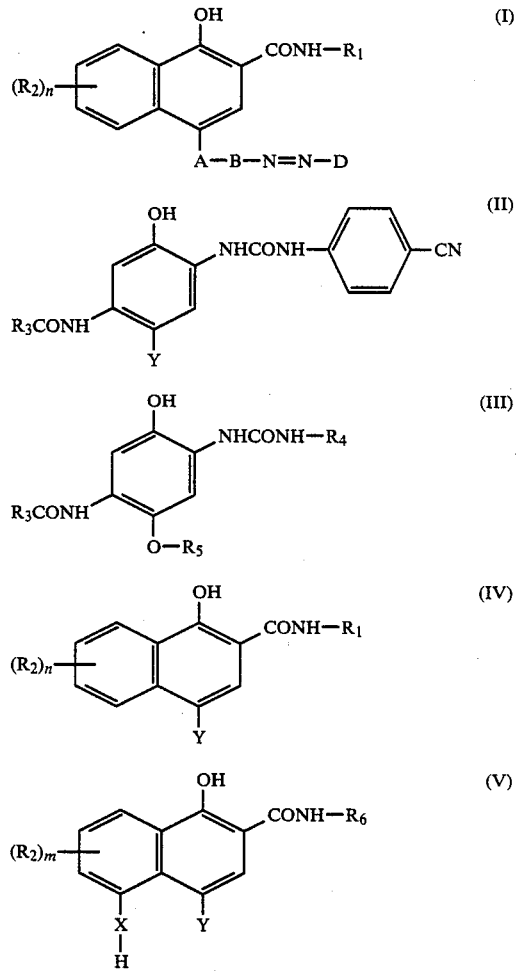

wherein $R_1$ represents an aromatic or heterocyclic group; $R_2$ represents a group capable of being substituted on a naphthol ring; $R_3$ represents an aliphatic, heterocyclic or aromatic group; $R_4$ represents an aromatic group excluding p-cyanophenyl groups; $R_5$ represents an aromatic or heterocyclic group; $R_6$ represents an aliphatic group; n represents an integer of 0 to 4; m represents an integer of 0 to 3; A-B-N=N-D represents a group which is eliminated upon coupling; A represents a divalent group whose bond to the carbon atom at the coupling active position of the coupler is cleaved upon the reaction with an oxidation product of a color developing agent; B represents a divalent aromatic or heterocyclic group; D represents an aromatic or heterocyclic group; Y represents a hydrogen atom or a group which is eliminated upon coupling; and X represents —O—, —S— or $$R_7-\overset{|}{N}-$$

in which $R_7$ represents a hydrogen atom or an organic substituent group, with the proviso that when n and m each represents a plural integer, $R_2$ may be the same as or different from each other or may be bonded to each other to form a ring. In the general formula (V), $R_2$ and X or X and Y may be bonded to each other to form a ring. $R_1$, $R_2$, $R_3$, $R_5$, $R_6$, $R_7$, X or Y may form a dimer or higher polymer. In the general formula (I), at least one of the groups represented by A, B and D has sulfo groups, carboxyl groups, or alkali metal or ammonium salts thereof as substituent groups.

DETAILED DESCRIPTION OF THE INVENTION

In the present invention, the aliphatic group means a substituted or unsubstituted aliphatic hydrocarbon group. The aromatic group means a substituted or unsubstituted aryl group which is optionally a condensed ring. The heterocyclic group means a substituted or unsubstituted single or condensed heterocyclic ring.

The substituent groups and the linkage groups in the above general formulae will be described in detail hereinafter.

The aromatic groups represented by $R_1$, $R_3$ and $R_5$ include substituted and unsubstituted aromatic groups having $C_{6-30}$ aromatic residual groups.

The aliphatic groups represented by $R_3$ and $R_6$ include substituted and unsubstituted aliphatic groups having $C_{1-30}$ aliphatic residual groups.

The heterocyclic groups represented by $R_1$, $R_3$ and $R_5$ include substituted and unsubstituted heterocyclic groups having $C_{2-30}$ heterocyclic residual groups.

$R_2$ represents a group (including an atom) capable of being substituted on a naphthol ring. Typical examples of such a group or an atom include a halogen atom, a hydroxy group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, and an imido group. $R_2$ contains 0 to 30 carbon atoms. When two $R_2$ form a ring, examples of cyclic $R_2$ include a dioxymethylene group.

$R_4$ represents a substituted or unsubstituted aromatic group having $C_{6-30}$ aromatic residual groups, excluding p-cyanophenyl groups.

X represents —O—, —S— or $$R_7\overset{|}{N}-$$

in which $R_7$ represents a hydrogen atom or a monovalent group. The monovalent group is preferably represented by the general formula (VI).

$$R_8-Y'\Big)_p- \qquad \text{(VI)}$$

wherein Y' represents —CO— or —$SO_2$—; p represents 0 or 1; and $R_8$ represents a hydrogen atom, a $C_{1-30}$ aliphatic group, a $C_{6-30}$ aromatic group, a $C_{2-30}$ heterocyclic group, —OH, —$OR_9$, —$COR_9$, —$SO_2R_9$, or $$-N\begin{matrix}R_9\\R_{10}\end{matrix},$$

with the proviso that $R_9$ and $R_{10}$ each represents a hydrogen atom or a group having the same meaning as defined in $R_3$ and that $R_9$ and $R_{10}$ may be the same as or different from each other in $$-N\begin{matrix}R_9\\R_{10}\end{matrix}.$$

When $R_8$ represents $$-N\begin{matrix}R_9\\R_{10}\end{matrix},$$

$R_9$ and $R_{10}$ may be bonded to each other to form a nitrogen-containing heterocyclic ring such as a morpholine ring, a piperidine ring, and a pyrrolidine ring.

Y represents a hydrogen atom or a group (including an atom) which is eliminated upon coupling. Typical examples of such a group or an atom include halogen atoms, —$OR_{11}$, —$SR_{11}$, $$-\underset{\underset{O}{\|}}{OCR_{11}},$$

—$NHSO_2R_{11}$, $$-\underset{\underset{O}{\|}}{OC}-OR_{11},\ -\underset{\underset{O}{\|}}{OCNHR_{11}},$$

and $C_{1-30}$ heterocyclic groups which are connected to the coupling active position of the coupler by a nitrogen atom such as a succinic acid imido group, a phthalimido group, a hydantoinyl group, a pyrazolyl group, and a 2-benzotriazolyl group. $R_{11}$ represents a $C_{1-30}$ aliphatic group, a $C_{6-30}$ aromatic group or a $C_{2-30}$ heterocyclic group.

A represents a divalent group derived from a group selected from the groups represented by Y, excluding halogen atoms, which is connected to B, excluding a whole group represented by $R_{11}$ (such as —O—, —S—, $$-\underset{\underset{O}{\|}}{OC}-,$$

—$NHSO_2$—, $$-\underset{\underset{O}{\|}}{OCO}- \quad \text{or} \quad -\underset{\underset{O}{\|}}{OCNH}-)$$

or a divalent group derived from a group selected from the groups represented by Y, excluding halogen atoms, which is connected to B at the substitutable position in a group represented by $R_{11}$. A contains 0 to 20 carbon atoms.

B represents a $C_{6-20}$ divalent aromatic group or a $C_{2-20}$ divalent heterocyclic group.

D represents a $C_{6-20}$ aromatic group or a $C_{2-20}$ heterocyclic group.

At least one of the groups represented by A, B and D has sulfo groups, carboxyl groups or salts thereof as substituent groups. With such a watersoluble group, the coupling elimination group represented by A-B-N=N-D discharges into the developing agent after being eliminated from the coupler residual group.

In the present invention, the aliphatic group may be a saturated or unsaturated, substituted or unsubstituted, straight chain, branched or cyclic aliphatic group. Typical examples of such an aliphatic group include a methyl group, an ethyl group, a hydroxyethyl group, a butyl group, a cyclohexyl group, an allyl group, a propargyl group, a methoxyethyl group, an n-decyl group, an n-dodecyl group, an n-hexadecyl group, a trifluoromethyl group, a heptafluoropropyl group, a dodecyloxypropyl group, a 2,4-di-tert-amylphenoxypropyl group, and a 2,4-di-tert-amylphenoxybutyl group.

The aromatic group may be a substituted or unsubstituted aromatic group. Typical examples of such an aromatic group include a phenyl group, a naphthyl group, a tolyl group, a 2-tetradecyloxyphenyl group, a pentafluorophenyl group, a 4-tert-octylphenyl group, a 2-chloro-5-dodecyloxycarbonylphenyl group, a 4-chlorophenyl group, a 4-methoxyphenyl group, and a 4-hydroxyphenyl group.

The heterocyclic group may be a substituted or unsubstituted heterocyclic group. Typical examples of such a heterocyclic group include a 2-pyridyl group, a 4-pyridyl group, a 2-furyl group, a 4-thienyl group, a quinonilyl group, and a 4-pyrazolyl group.

Preferred examples of the substituent groups of the present invention will be described hereinafter.

$R_1$ is preferably an aromatic group. Preferred examples of the substituent groups for such an aromatic group include alkoxy groups such as tetradecyloxy group and a methoxy group, alkoxycarbonyl groups such as a dodecyloxycarbonyl group and a methoxycarbonyl group, acylamino groups such as a 4-(2,4-di-tert-amylphenoxy)-butanamido group and a tetradecanamido group, sulfonamido groups such as a hexadecylsulfonamido group, sulfamoyl groups such as a 3-(2,4-di-tert-amylphenoxy)propylsulfamoyl group, and a hexadecylsulfamoyl group, carbamoyl groups such as a dodecylcarbamoyl group and a 4-(2,4-di-tert-amylphenoxy)butylcarbamoyl group, imido groups such as a dodecylsuccinimido group and an octadecenylsuccinimido group, sulfonyl groups such as a dodecylsulfonyl group, a propanesulfonyl group and a methanesulfonyl group, aliphatic thio groups such as a dodecylthio group and an ethylthio group, halogen atoms, cyano groups, and aliphatic groups such as a methyl group and a t-butyl group. $R_1$ is more preferably a substituted or unsubstituted phenyl group.

When n=0, $(R_2)_n$ provides the most preferable compound, and when m=0, $(R_2)_m$ provides the most preferable compound. $R_2$ is preferably a halogen atom, an aliphatic group such as a methyl group, an ethyl group and a t-octyl group, acylamino groups such as an acetamido group and a butanamido group, sulfonamido groups such as a benzenesulfonamido group and a methanesulfonamido group, or alkoxyacylamino gorups such as an ethoxycarbonylamino group and an isobutoxycarbonylamino group.

$R_3$ is preferably an aliphatic group. Examples of such an aliphatic group include a methyl group, a propyl group, a tert-butyl group, a pentyl group and a tridecyl group, and these groups may have substituent groups. Preferred examples of the substituent groups for such an aliphatic group include aromatic oxy groups such as a 2,4-di-tert-amylphenoxy group, a 2,4-di-tert-hexylphenoxy group, a 2,4-di-tert-octylphenoxy group, a 2-chlorophenoxy group and a 4-(4-hydroxyphenylsulfonyl)-phenoxy group, aliphatic oxy groups such as a methoxy group, an ethoxy group, a dodecyloxy group and a hexadecyloxy group, and sulfonamido groups such as a methanesulfonamido group and a 4-methylbenzenesulfonamido group. $R_3$ is more preferably an aliphatic group substituted by an aryloxy group.

The aromatic group represented by $R_4$ is preferably a substituted or unsubstituted phenyl group. Preferred substituent groups for the phenyl group include those described as preferred substituent groups for $R_1$ wherein $R_1$ is an aromatic group. However, when the benzene ring has a cyano group at the p-position, the o-position and the m-position do not have a hydrogen atom at the same time.

$R_5$ is preferably an aromatic group, more preferably a substituted or unsubstituted phenyl group. Preferred examples of substituent groups for such a phenyl group include aliphatic groups such as a methyl group, a t-butyl group and a t-octyl group, aromatic groups such as a phenyl group, aliphatic oxy groups such as a methoxy group, a butoxy group and a benzyloxy group, aliphatic thio groups such as a methylthio group and a benzylthio group, aromatic oxy groups such as a phenoxy group, sulfonamido groups such as a p-toluenesulfonamido group and a methanesulfonamido group, hydroxyl groups, carboxyl groups, halogen atoms, and sulfo groups.

Preferred examples of the aliphatic group represented by $R_6$ include an ethyl group, a propyl group, a butyl group, a dodecyl group and a hexadecyl group, and those groups may have substituent groups. Preferred examples of such substituent groups include those described as preferred substituent groups for $R_3$ wherein $R_3$ is an aliphatic group.

X is preferably $$\overset{|}{R_7N}-$$

in which $R_7$ represents $-COR_8$ such as a formyl group, an acetyl group, a trifluoroacetyl group, a chloroacetyl group, a benzoyl group, a pentafluorobenzoyl group and a p-chlorobenzoyl group, $-COOR_9$ such as a methoxycarbonyl group, an ethoxycarbonyl group, a butoxycarbonyl group, a decyloxycarbonyl group, a methoxyethoxycarbonyl group and a phenoxycarbonyl group, $-SO_2R_8$ such as a methanesulfonyl group, an ethanesulfonyl group, a butanesulfonyl group, a hexadecanesulfonyl group, a benzenesulfonyl group, a toluenesulfonyl group and a p-chlorobenzenesulfonyl group,

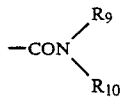

such as an N,N-dimethylcarbamoyl group, an N,N-diethylcarbamoyl group, an N,N-dibutylcarbamoyl group, a morpholinocarbonyl group, a piperidinocarbonyl group, a 4-cyanophenylcarbonyl group, a 3,4-dichlorophenylcarbamoyl group, a 4-methanesulfonylphenylcarbamoyl group, or

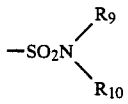

such as an N,N-dimethylsulfamoyl group, an N,N-diethylsulfamoyl group and an N,N-dipropylsulfamoyl group. Particularly preferred X are $—COR_8$, $—COOR_9$ and $—SO_2R_8$ wherein $R_8$ and $R_9$ are as defined above.

Preferred examples of Y include a hydrogen atom, a halogen atom, $—OR_{11}$ and $—SR_{11}$ (wherein $R_{11}$ represents a $C_{1-30}$ aliphatic group, a $C_{6-30}$ aromatic group or a $C_{2-30}$ heterocyclic group) and more preferred examples of Y include a hydrogen atom, a chlorine atom, an aliphatic oxy group, an aromatic oxy group and a heterocyclic thio group.

A preferred A is represented by the formula $—S—A'(Z)_l]_q$ or $—O—A'(Z)_l]_q$ wherein A' represents a $C_{1-6}$ divalent aliphatic group such as $(CH_2)_2$, $(CH_2)_3$, $(CH_2)_4$,

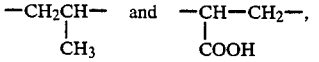

or a phenylene group; Z represents —O—, —S—, —COO—, —CO—, —CONH—, $—SO_2NH—$, $—SO_2—$ or —NHCONH—; l represents an integer of 0 or 1; and q represents an integer of 0 to 2, with the proviso that when q represents an integer of 2, A', Z and l may be the same as or different from each other. More preferred examples of A include —O— and —S—.

B is preferably a divalent aromatic group, particularly preferably a phenylene group such as

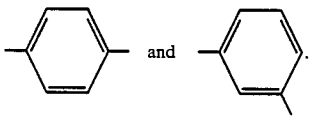

D is preferably a group represented by the general formula (VII) or (VIII) shown below. These are useful groups for the formation of magenta colored cyan couplers.

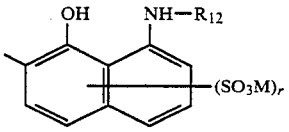

(VII)

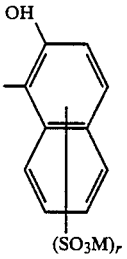

(VIII)

wherein $R_{12}$ represents $—COR'_8$, $—COOR'_9$, $—SO_2R'_8$ or a hydrogen atom in which $R'_8$ and $R'_9$ are as defined for $R_8$ and $R_9$, respectively, with the proviso that the number of carbon atoms contained therein is 8 or less. M represents a hydrogen atom or a cation such as an alkali metal ion or an ammonium ion, and r represents an integer of 1 or 2.

D more preferably represents a group represented by the general formula (VIIA):

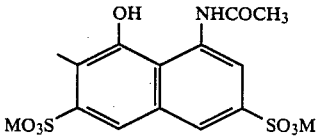

(VIIA)

wherein M represents an alkali metal ion or a hydrogen atom.

The couplers represented by the general formulae (I), (II), (III), (IV) and (V), especially (II), (III), (IV) and (V) may form in its substituent groups dimers or higher polymers which are bonded to each other via a divalent group or a group having a higher valency. In this case, the number of carbon atoms contained in these substituent groups is not limited.

When the couplers represented by the above general formulae form polymers, typical examples of such polymers include homopolymers of addition polymerizable ethylenically unsaturated compounds having cyan dye forming coupler residual groups (cyan coloring monomer) and copolymers thereof. In this case, the polymers have repeating units represented by the general formula (IX). The polymers may contain one or more of such cyan coloring repeating units represented by the general formula (IX). When the polymers are copolymers, such copolymers may contain one or more noncoloring ethylenic monomers.

(IX)

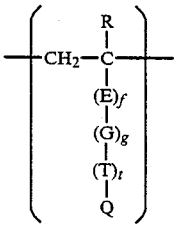

wherein R represents a hydrogen atom, a chlorine atom or a $C_{1-4}$ alkyl group; E represents —CONH—, —COO— or a substituted or unsubstituted phenylene group; G represents a substituted or unsubstituted alkylene group, a phenylene group or an aralkyl group; T represents —CONH—, —NHCONH—, —NHCOO—, —NHCO—, —OCONH—, —NH—, —COO—, —OCO—, —CO—, —O—, —$SO_2$—, —$NHSO_2$— or —$SO_2NH$—; f, g and t each represents an integer of 0 or 1; and Q represents a cyan coupler residual group in which the compounds represented by the general formulae (I) to (V) have hydrogen atoms eliminated therefrom.

The polymers are preferably copolymers of cyan coloring monomers providing coupler units represented by the general formula (IX) and noncoloring ethylenic monomers described hereinafter.

As noncoloring ethylenic monomers which do not undergo coupling with an oxidation product of an aromatic primary amine developing agent there may be employed acrylic acid, α-chloroacrylic acid, α-alacrylic acid such as methacrylic acid, ester or amide derived therefrom, such as acrylamide, methacrylamide, n-butylacrylamide, t-butylacrylamide, diacetoneacrylamide, methylenebisacrylamide, methylacrylate, ethylacrylate, n-propylacrylate, n-butylacrylate, t-butylacrylate, isobutylacrylate, 2-ethylhexylacrylate, n-octylacrylate, laurylacrylate, methylmethacrylate, ethylmethacrylate, n-butylmethacrylate and β-hydroxymethacrylate, vinyl ester such as vinyl acetate, vinyl propionate, and vinyl laurate, acrylonitrile, methacrylonitrile, aromatic vinyl compound such as styrene and derivative thereof, e.g., vinyl toluene, divinyl benzene, vinyl acetophenone and sulfostyrene, itaconic acid, citraconic acid, crotonic acid, vinylidene chloride, vinyl alkyl ether such as vinyl ethyl ether, maleic ester, N-vinyl-2-pyrrolidone, N-vinylpyridine and 2- and 4-vinylpyridine.

Particularly preferred examples among these compounds are acrylic ester, methacrylic ester and maleic ester. These noncoloring ethylenic monomers may be used singly or in combination thereof. For example, combinations of methylacrylate and butylacrylate, butylacrylate and styrene, butylacrylate and methacrylic acid, and methylacrylate and diacetoneacrylamide may be used.

As is well known in the field of polymer couplers, when a polymer coupler containing repeating units represented by the general formula (IX) is prepared, the noncoloring ethylenic monomer which is to be copolymerized with the ethylenic monomer having cyan dye forming residual groups of the present invention can be so chosen that the physical and/or chemical properties of the resulting copolymer, such as solubility, compatibility with a binder for the photographic colloid composition such as gelatin, flexibility, thermal stability, and the like are favorably affected thereby.

The preparation of dispersion containing the polymer couplers may be effected by emulsifying a solution of a cyan polymer coupler to be used in the present invention (lipophilic polymer coupler obtained by the polymerization of vinyl monomers containing coupler units represented by the general formula (IX)) in an organic solvent into an aqueous gelatin solution in the form of latex or by a direct emulsion polymerization process.

The method of emulsion-dispersing a lipophilic polymer coupler into an aqueous gelatin solution in the form of latex may be accomplished as described in U.S. Pat. No. 3,451,820. The emulsion polymerization process may be accomplished as described in U.S. Pat. Nos. 4,080,211 and 3,370,952.

Specific examples of the couplers represented by the general formula (I) are described hereinafter, but the couplers to be used in the present invention should not be construed as being limited thereto. In the structural formulae shown below, —(t)$C_5H_{11}$ and —(t)$C_8H_{17}$ represent —$C(CH_3)_2C_2H_5$ and —$C(CH_3)_2CH_2C(CH_3)_3$, respectively.

Specific examples of couplers represented by the general formula (I):

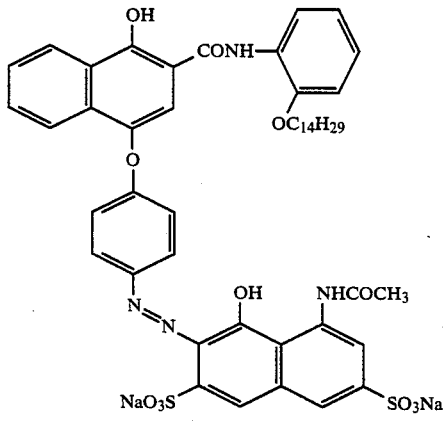

I-(1)

-continued
I-(2)
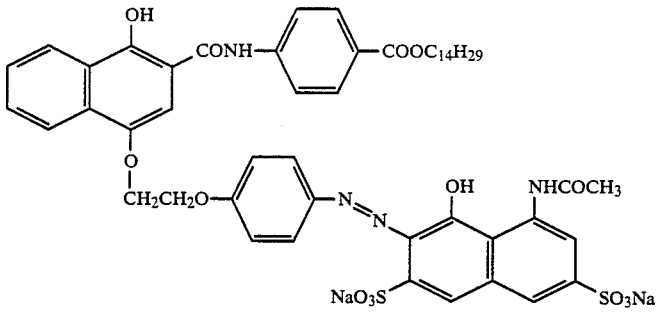
I-(3)
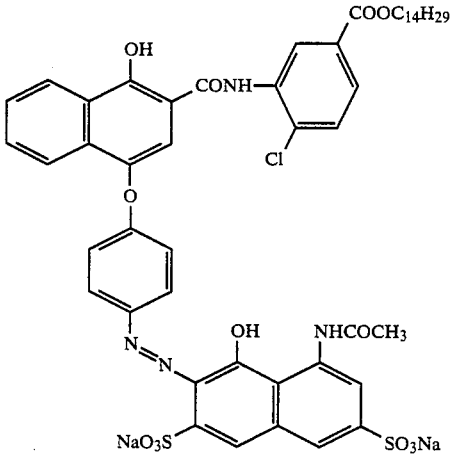
I-(4)
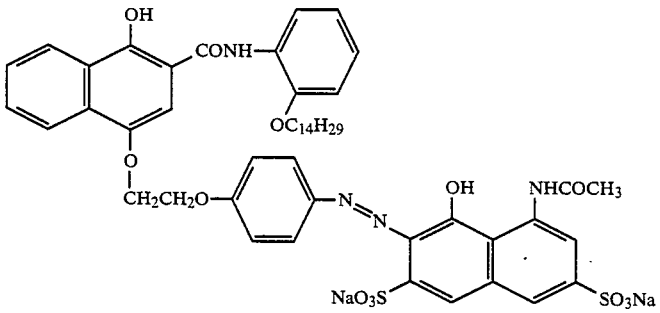
I-(5)
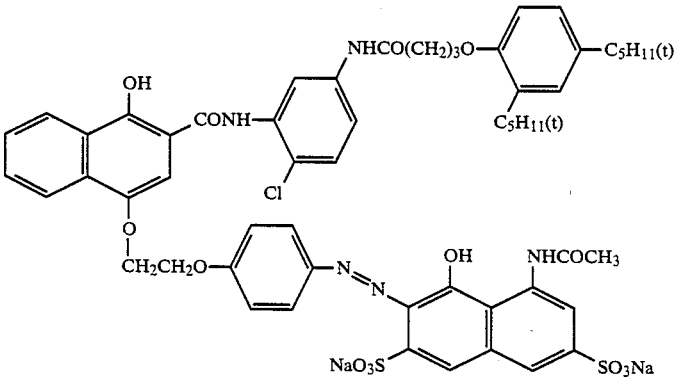

-continued
I-(6)
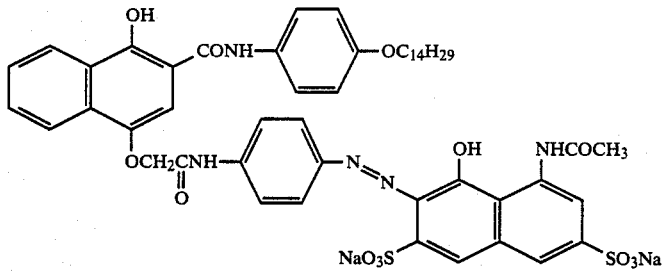
I-(7)
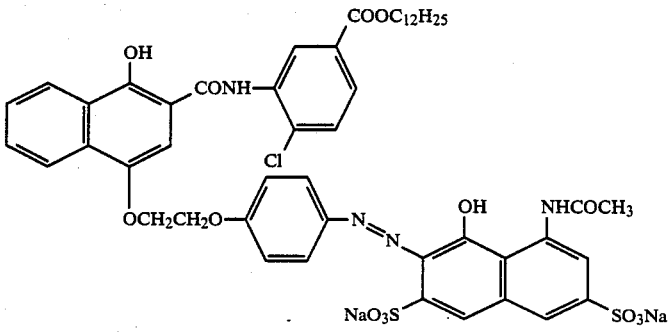
I-(8)
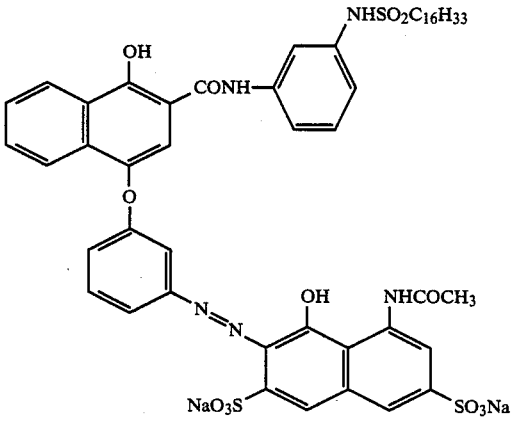
I-(9)
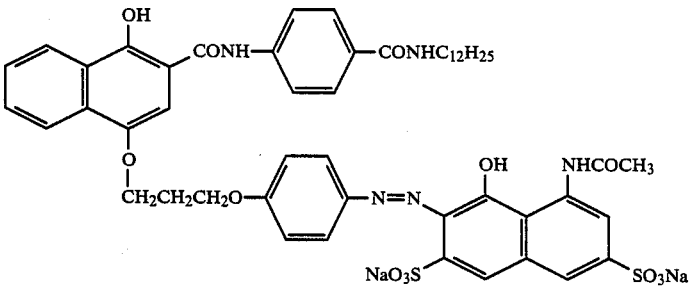
I-(10)
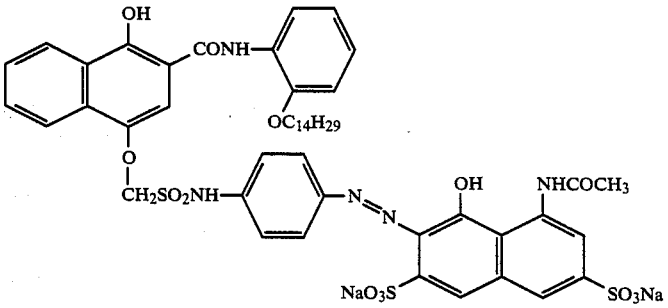

-continued
I-(11)
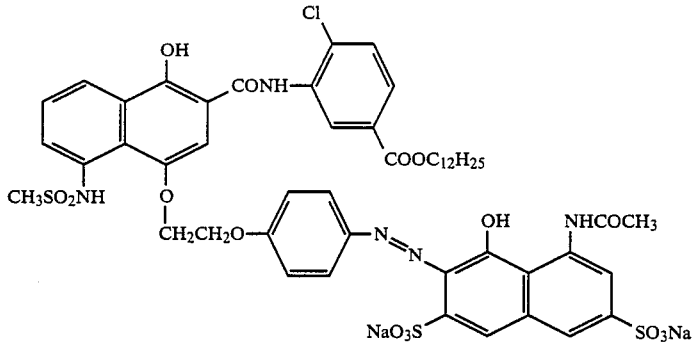
I-(12)
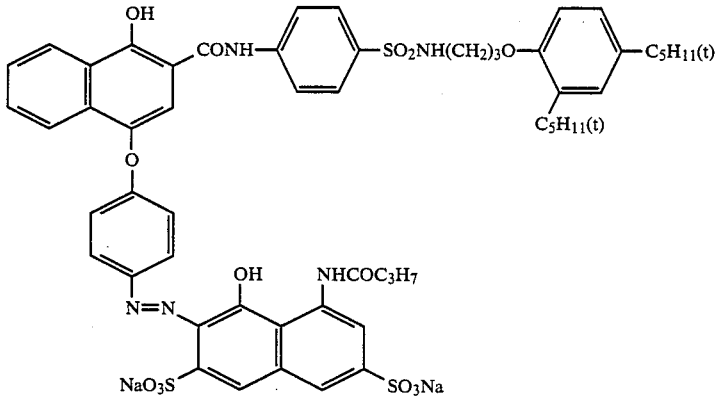
I-(13)
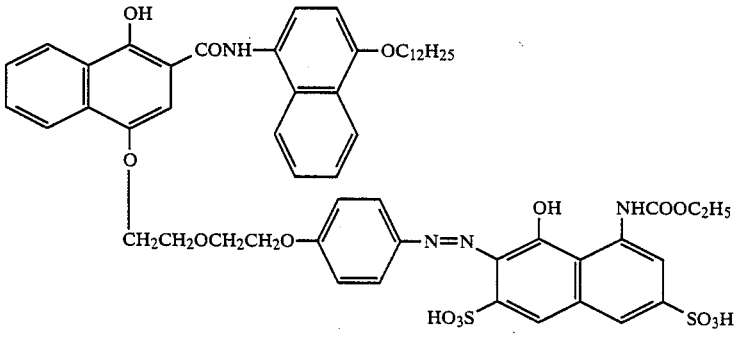
I-(14)
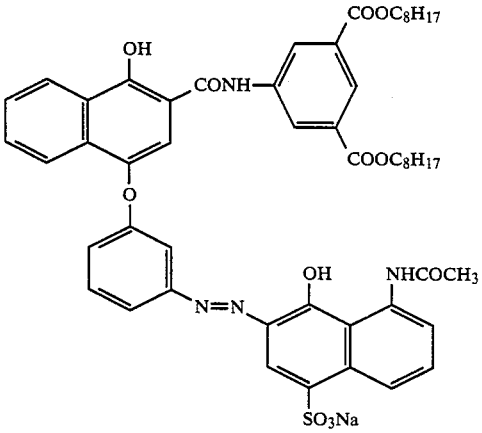

-continued
I-(15)
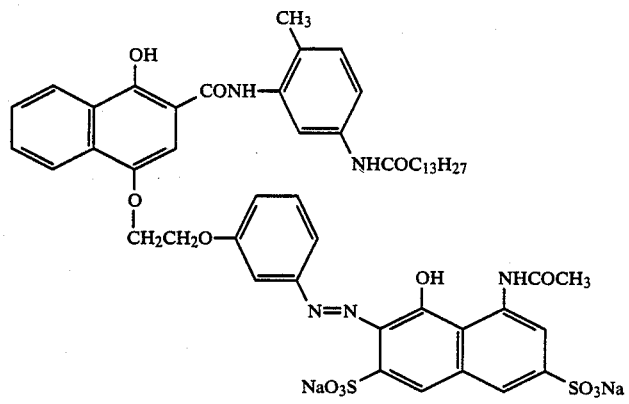
I-(16)
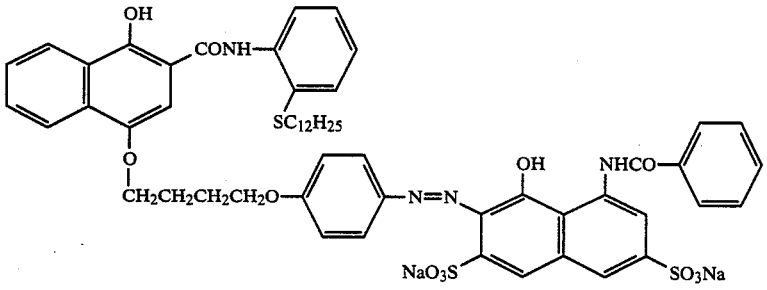
I-(17)
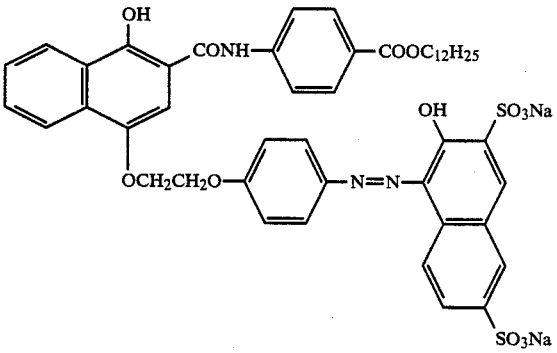
I-(18)
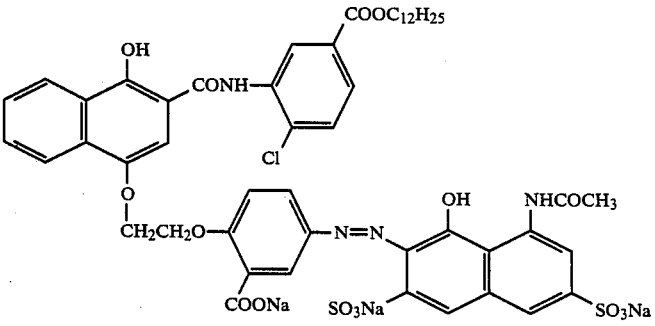

-continued
I-(19)
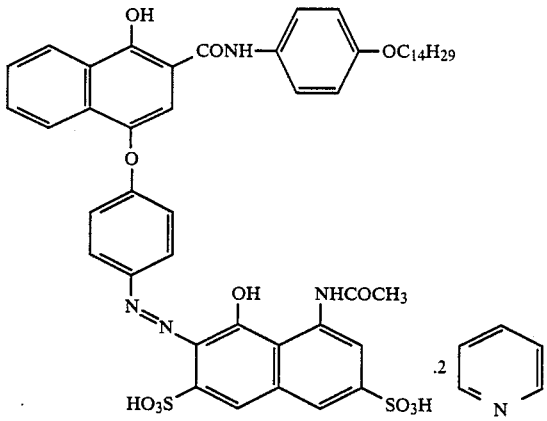
I-(20)
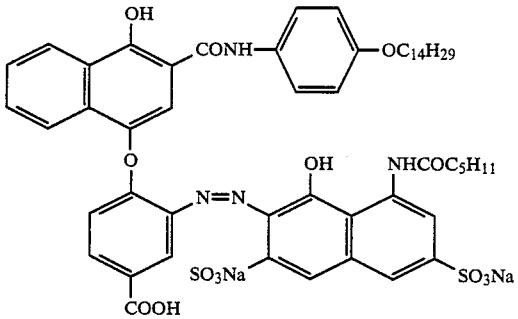
I-(21)
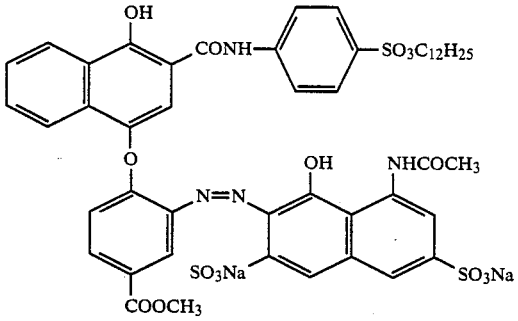
I-(22)
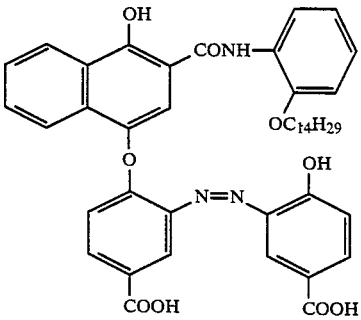

-continued
I-(23)
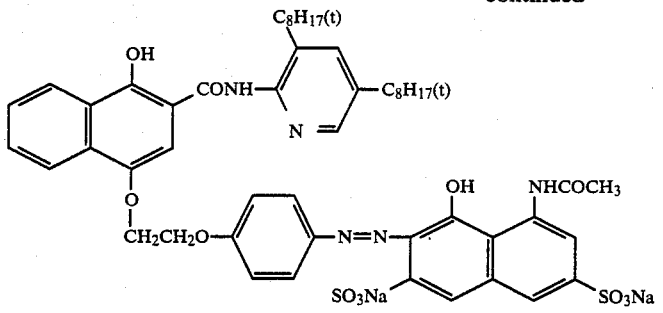
I-(24)
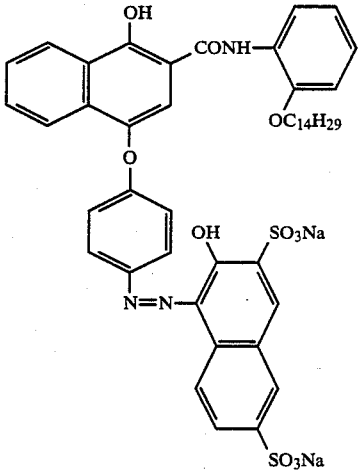
I-(25)
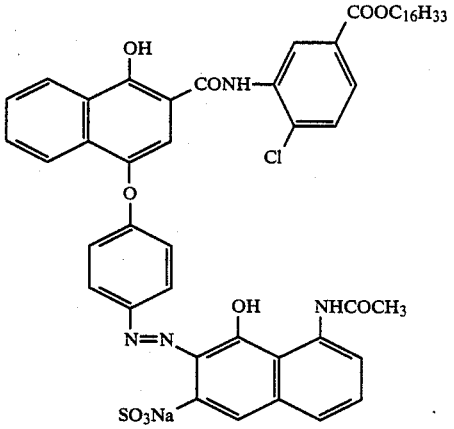
I-(26)
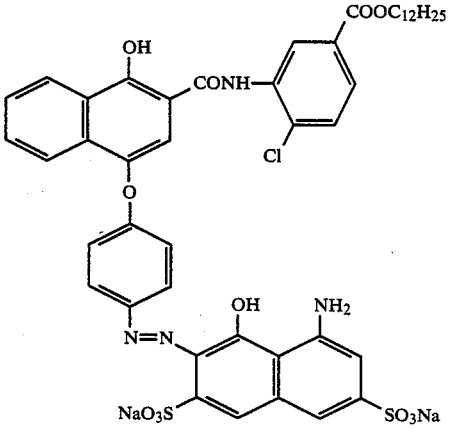

-continued
I-(27)
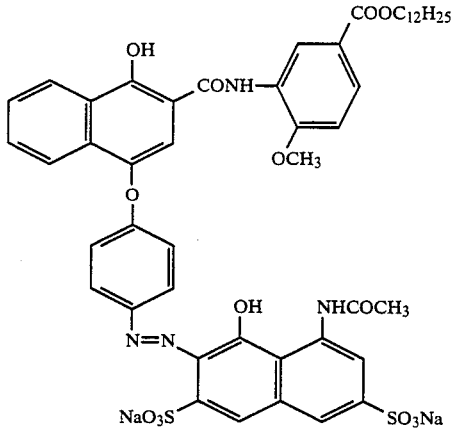
I-(28)
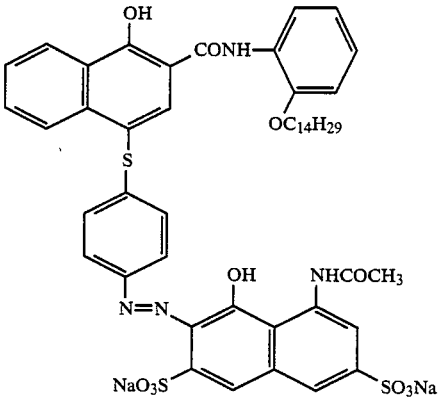
I-(29)
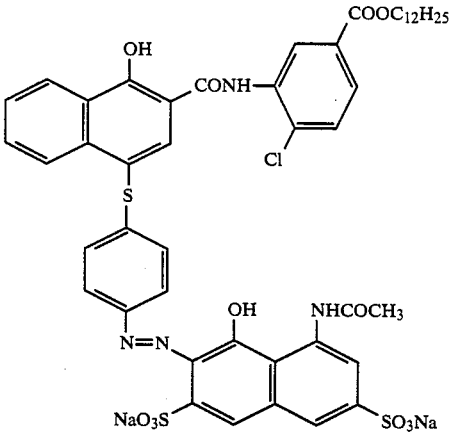
Specific examples of couplers represented by the general formula (II):
II-(1)
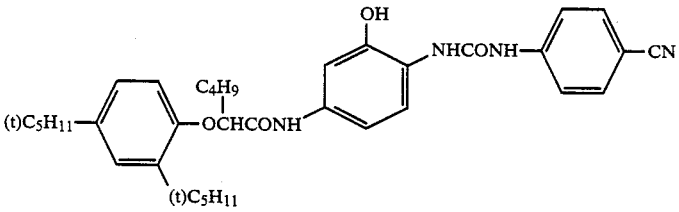

-continued
II-(2)
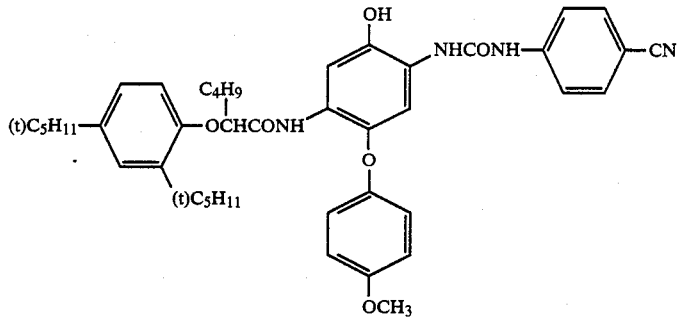
II-(3)
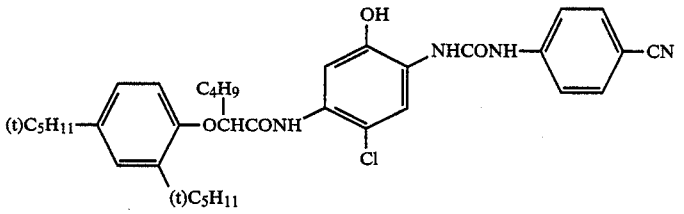
II-(4)
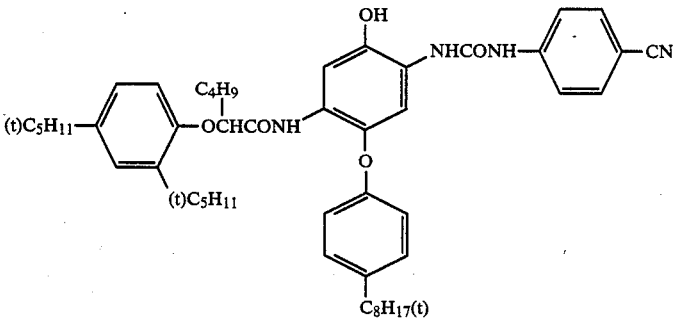
II-(5)
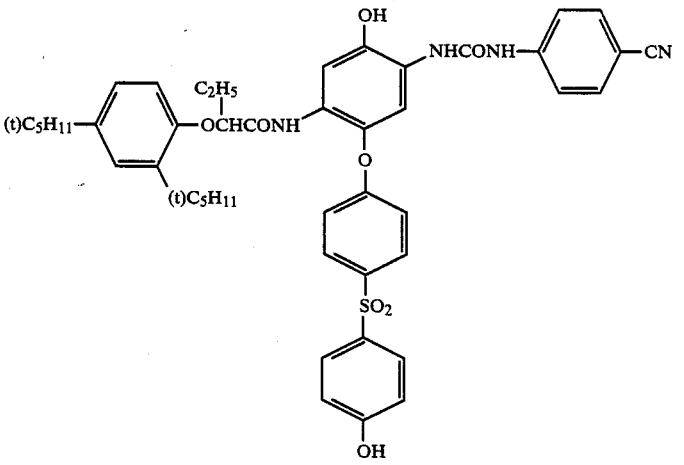

-continued
II-(6)
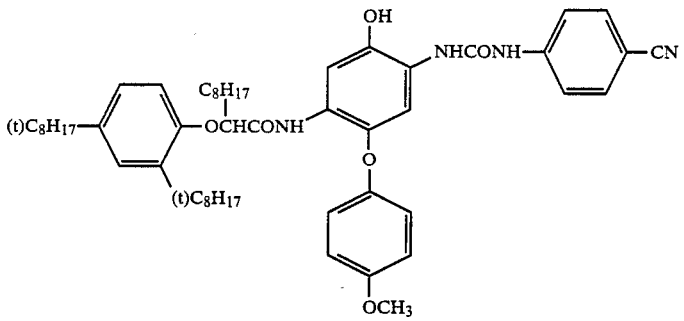
II-(7)
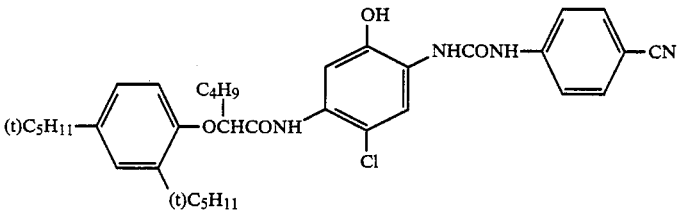
II-(8)
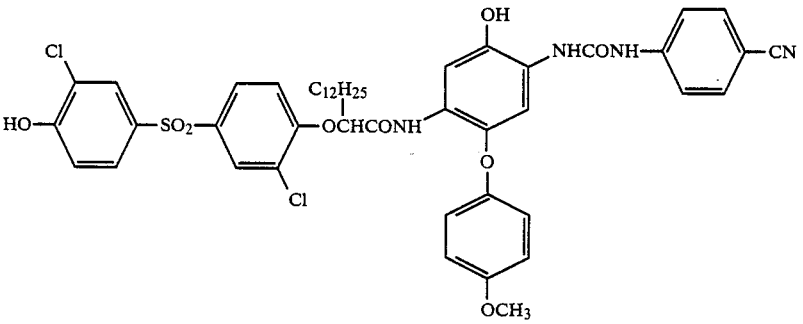
II-(9)
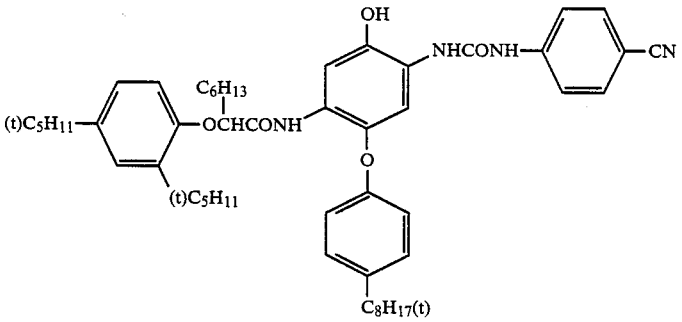
II-(10)
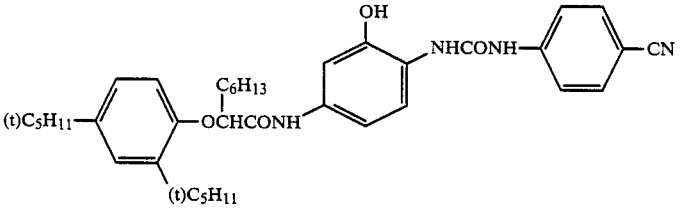

-continued
II-(11)
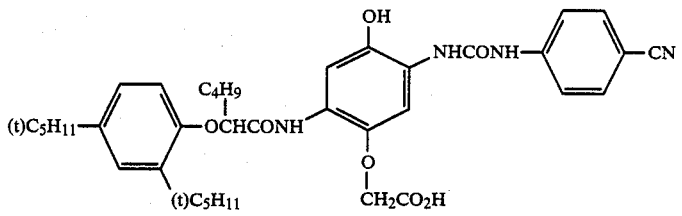
II-(12)
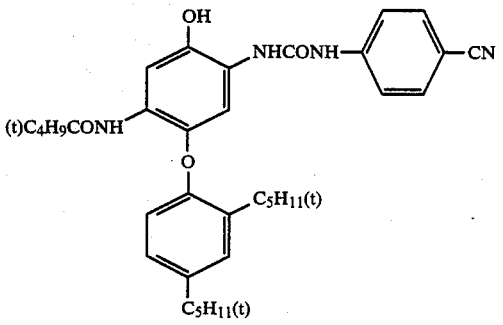
II-(13)
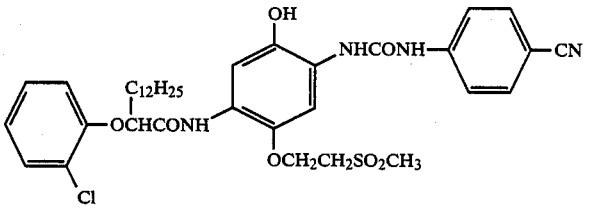
II-(14)
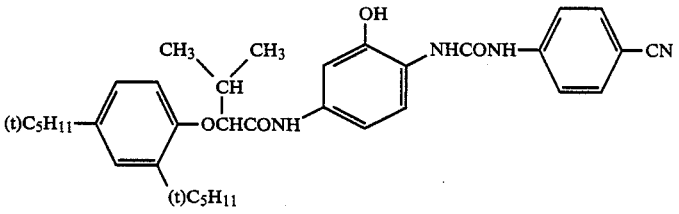
II-(15)
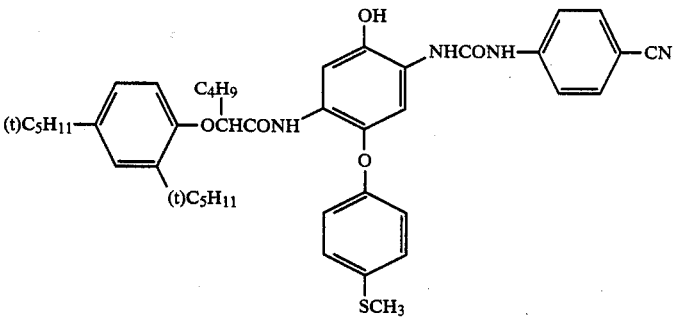
II-(16)
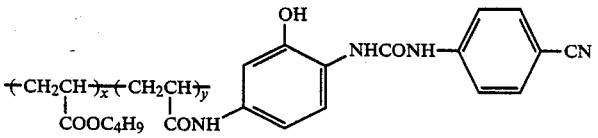
x:y = 50:50 (molar ratio)
Specific examples of couplers represented by the general formula (III):

III-(1)
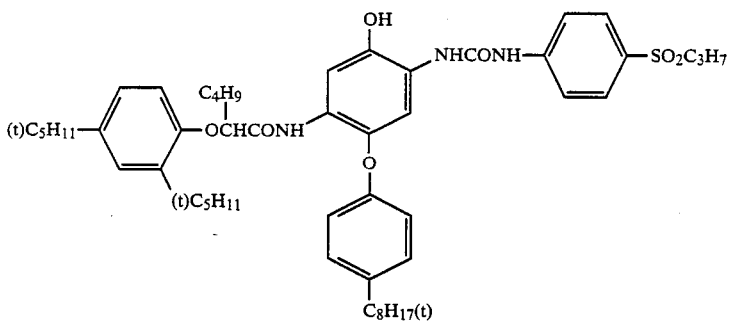
III-(2)
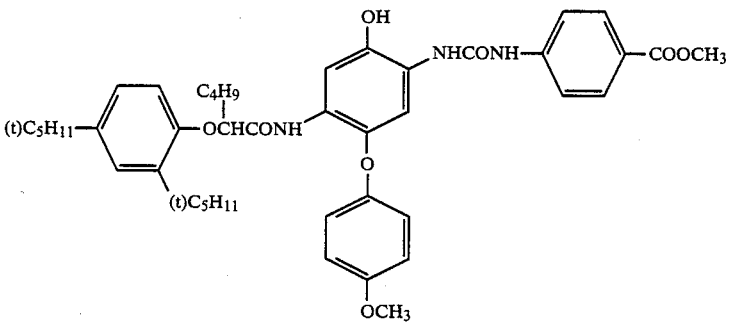
III-(3)
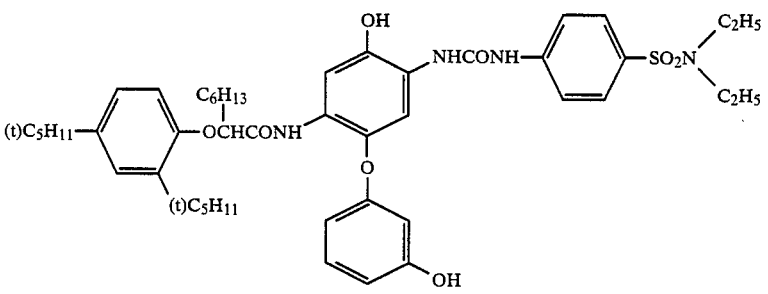
III-(4)
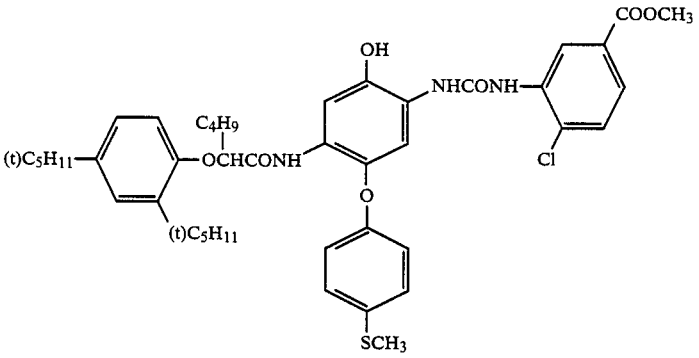
III-(5)
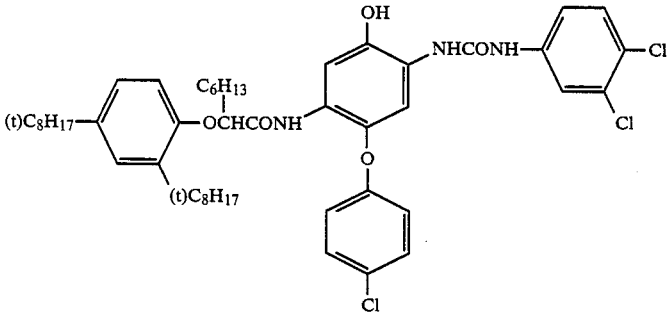

-continued
III-(6)
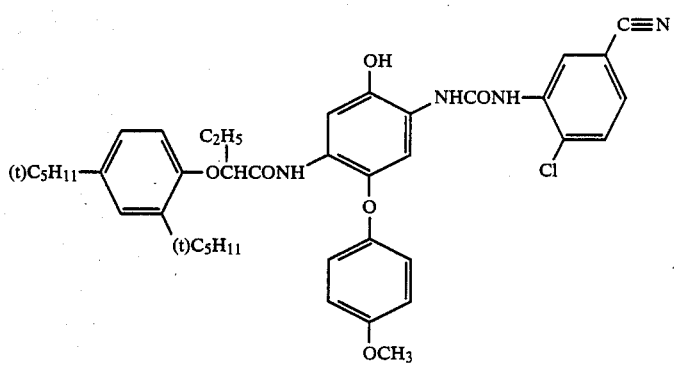
III-(7)
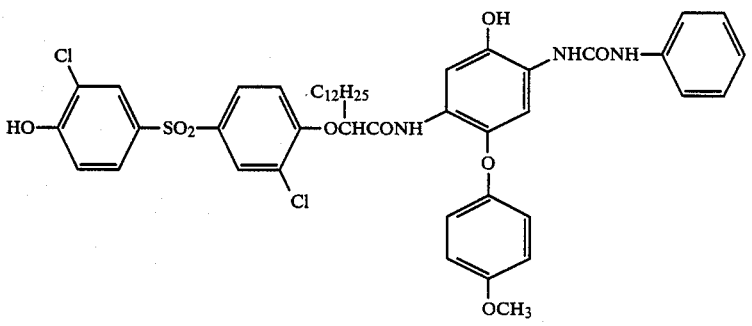
III-(8)
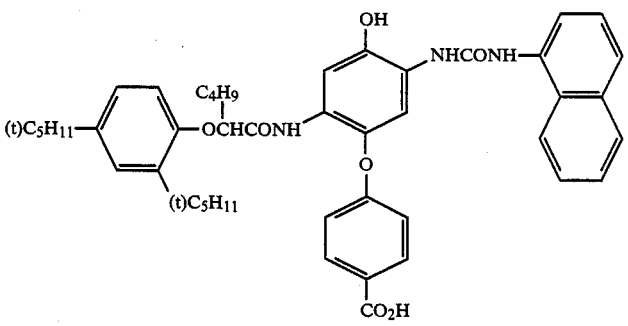
III-(9)
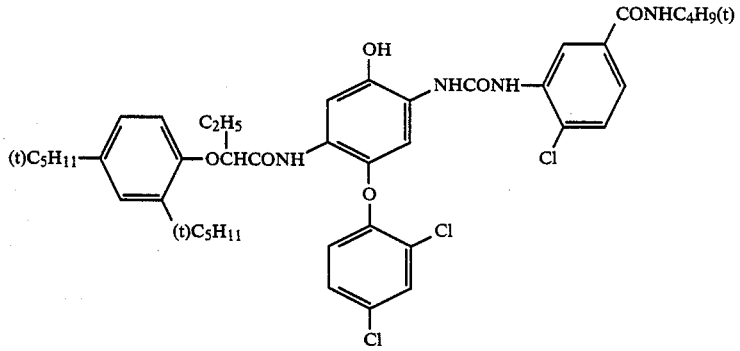

-continued
III-(10)
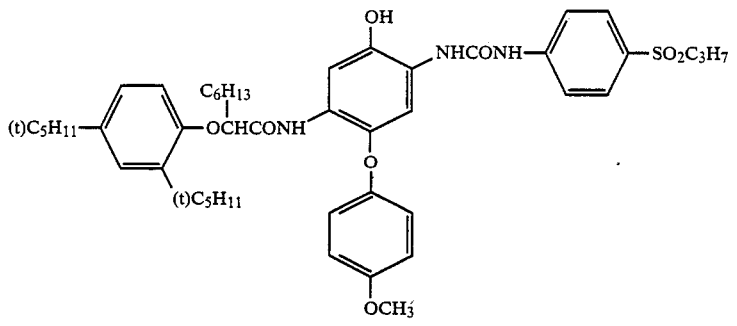
III-(11)
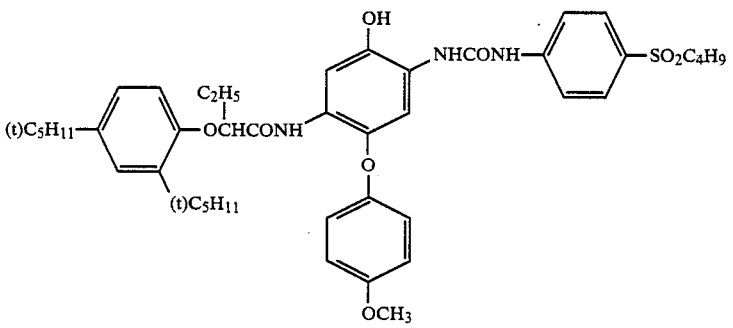
III-(12)
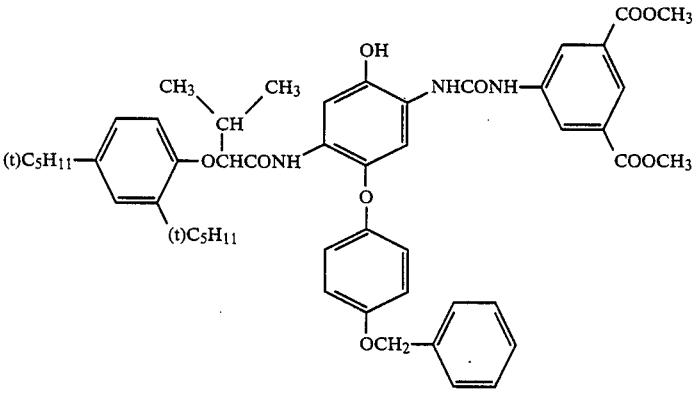
III-(13)
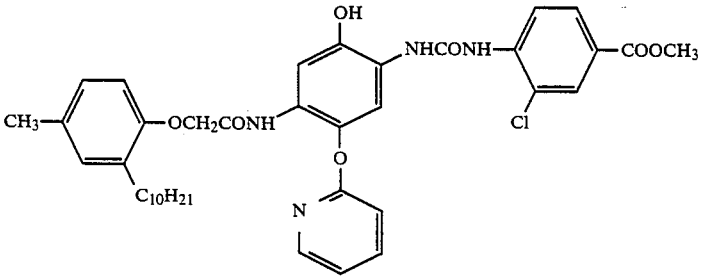

-continued
III-(14)
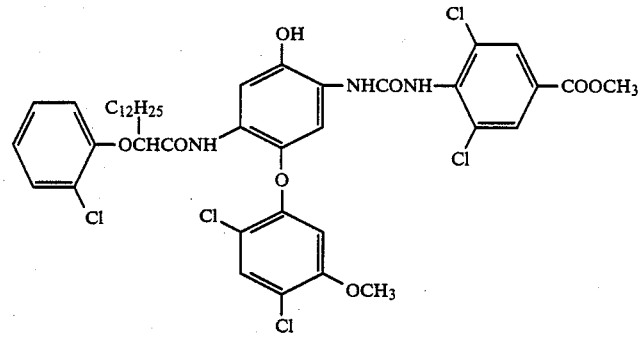
III-(15)
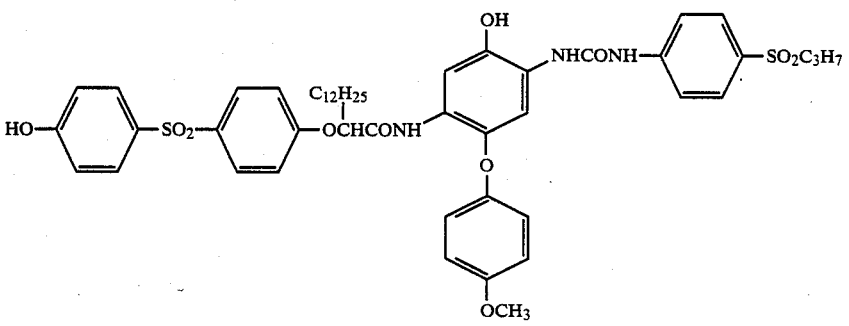
III-(16)
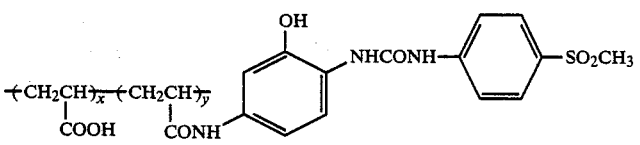
x:y = 40:60 (molar ratio)
Specific examples of couplers represented by the general formula (IV):
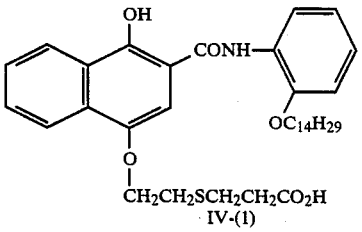
IV-(1)
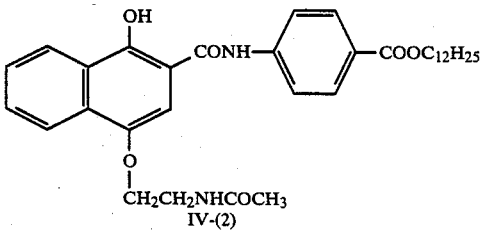
IV-(2)
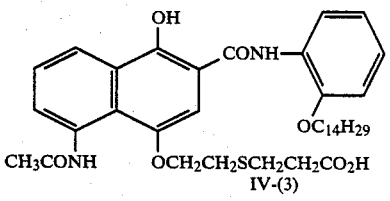
IV-(3)

-continued
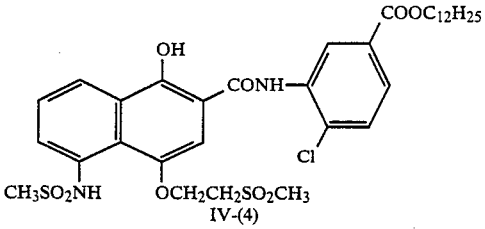
IV-(4)
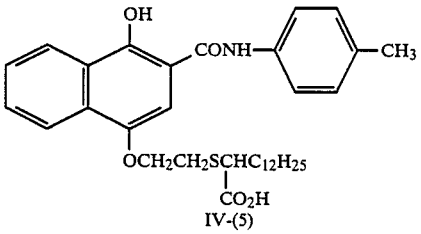
IV-(5)
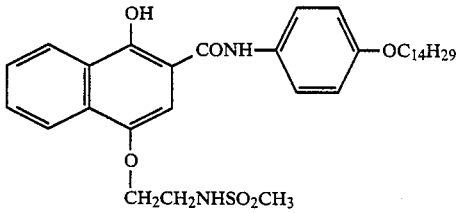
IV-(6)
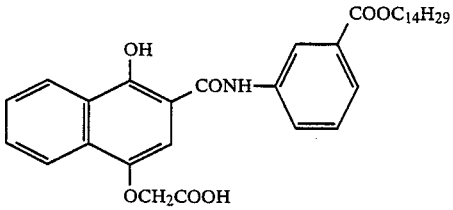
IV-(7)
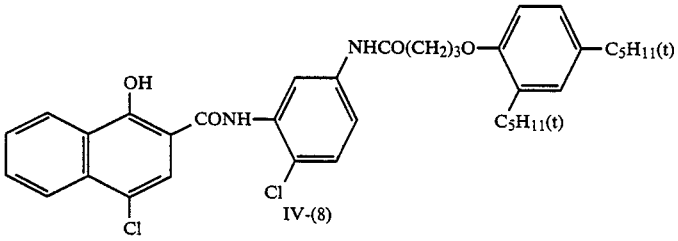
IV-(8)
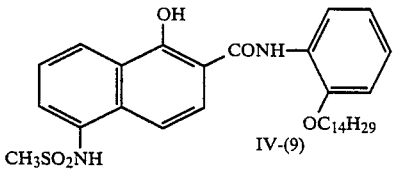
IV-(9)

-continued
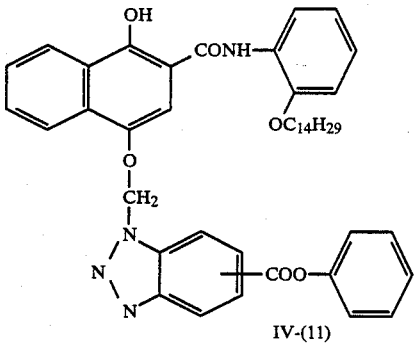
IV-(11)
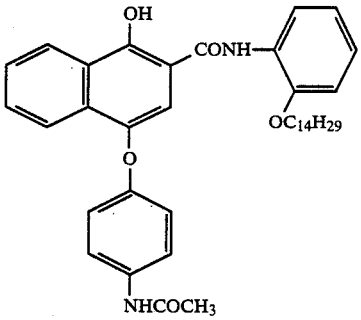
IV-(11)
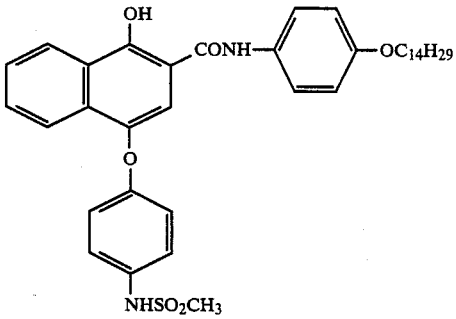
IV-(12)
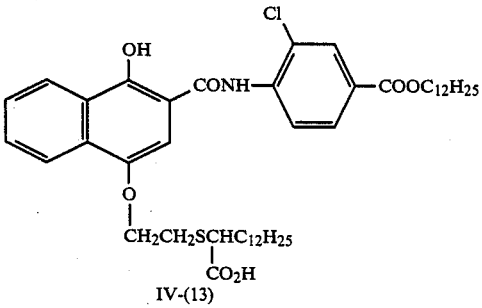
IV-(13)

-continued
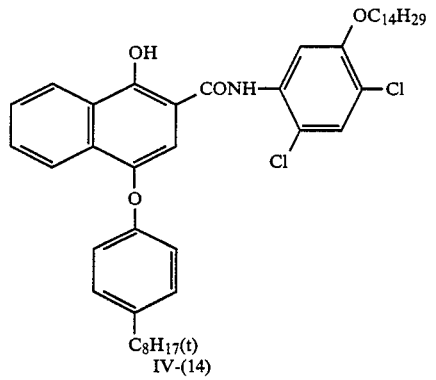
IV-(14)
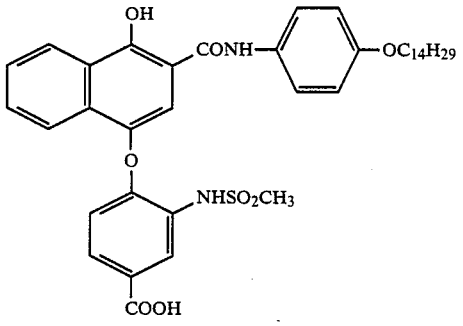
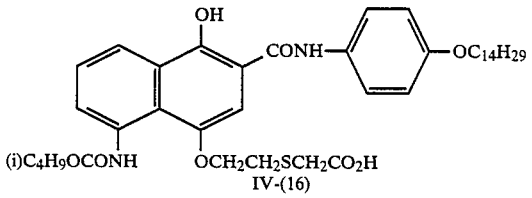
IV-(16)
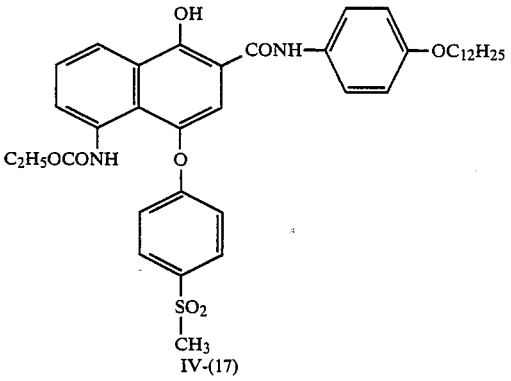
IV-(17)
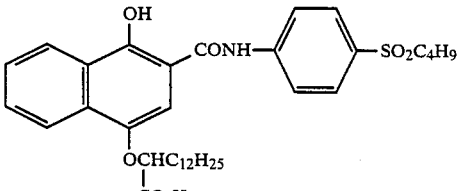
IV-(18)

-continued
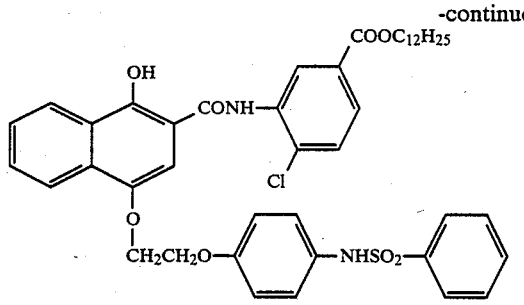
IV-(19)
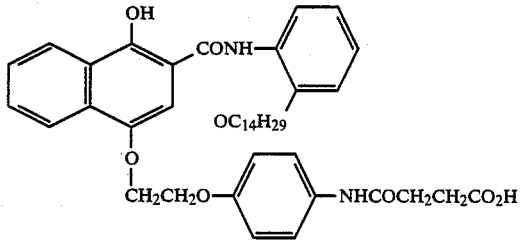
IV-(20)
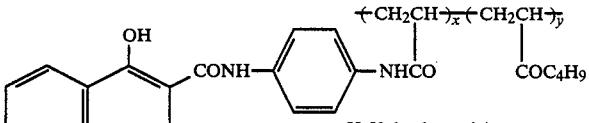
x:y = 50:50 (molar ratio)
IV-(21)
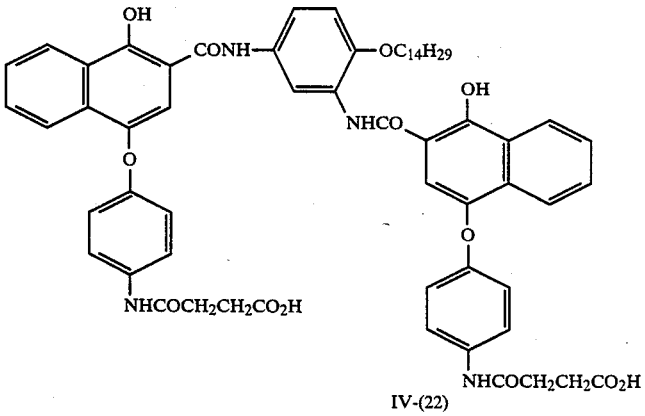
IV-(22)
Specific examples of couplers represented by the general formula (V):
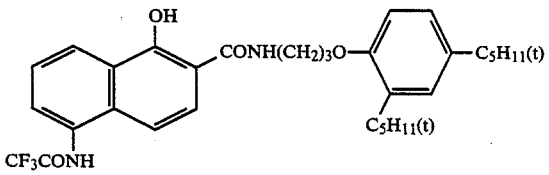
V-(1)
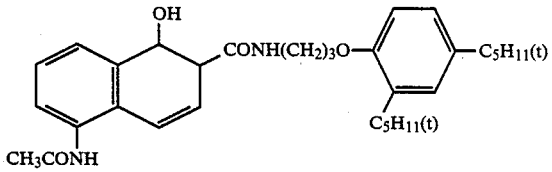
V-(2)

-continued
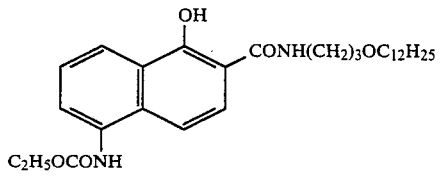
V-(3)
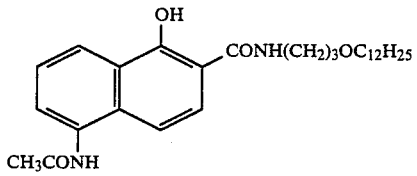
V-(4)
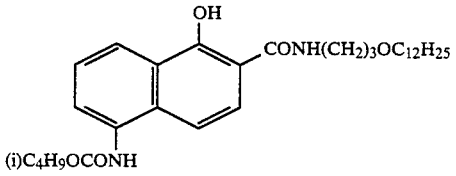
V-(5)
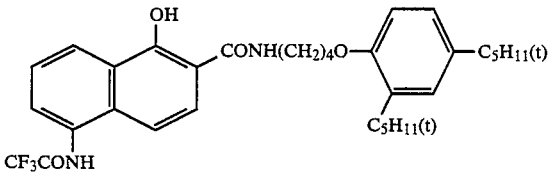
V-(6)
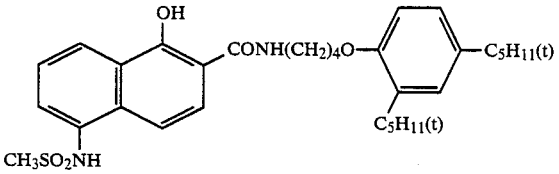
V-(7)
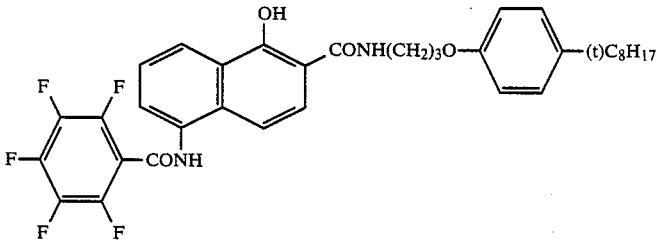
V-(8)
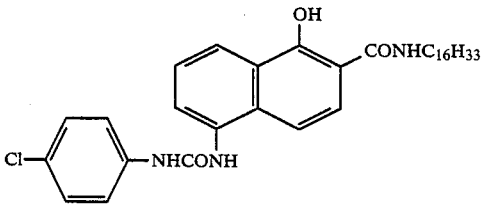
V-(9)
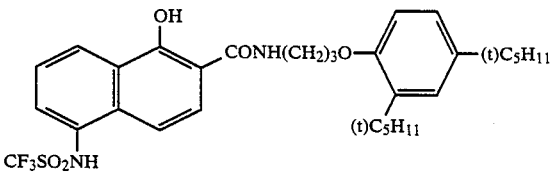
V-(10)

-continued
V-(11)
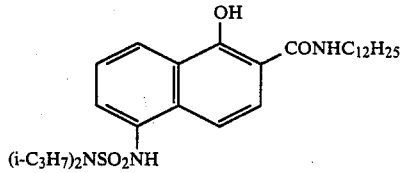
V-(12)
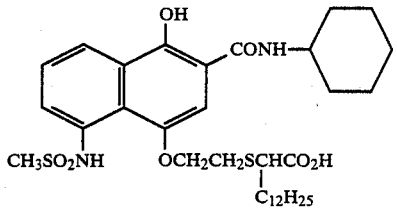
V-(13)
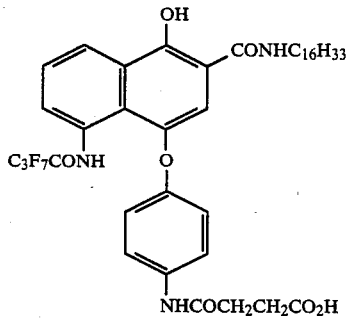
V-(14)
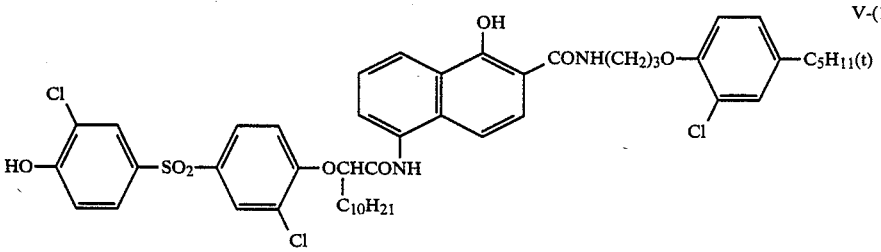
V-(15)
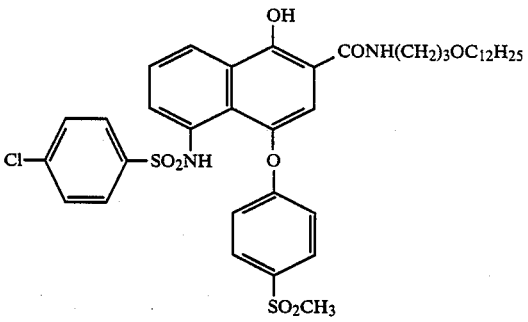
V-(16)
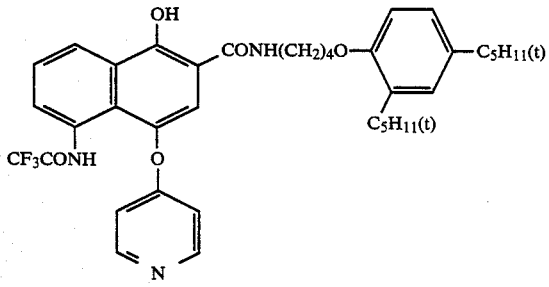

-continued
V-(17)
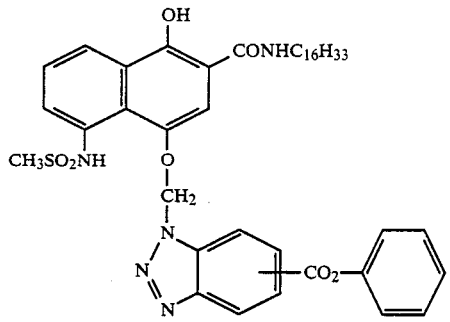
V-(18)
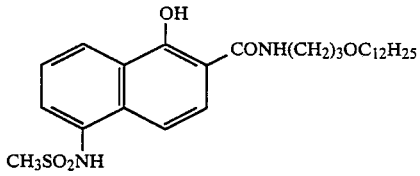
V-(19)
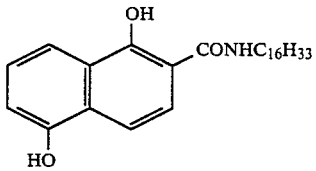
V-(20)
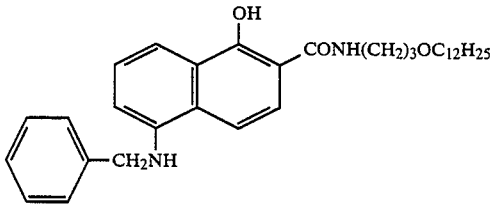
V-(21)
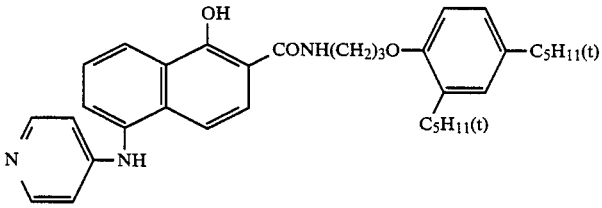
V-(22)
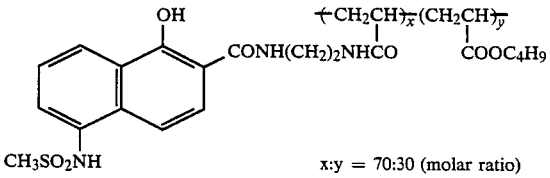
x:y = 70:30 (molar ratio)
V-(23)
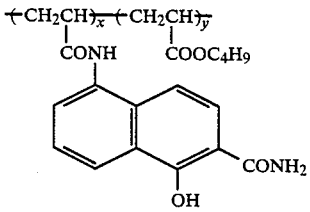
x:y = 50:50 (molar ratio)

-continued

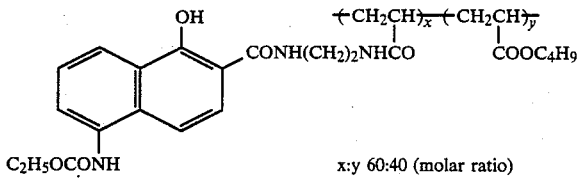

x:y 60:40 (molar ratio)

V-(24)

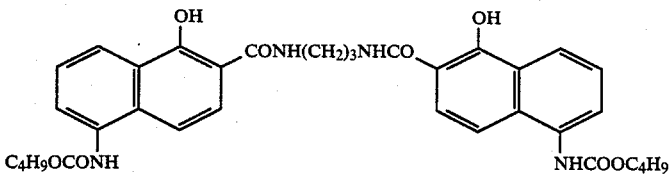

V-(25)

As the colored coupler of the present invention there may be employed a colored coupler having absorption in the range of 400 to 600 nm, preferably having a main absorption in the range of 500 to 600 nm (green light).

The colored coupler of the present invention may be used in an amount depending on its spectral absorption property and relative coupling activity in combination with the cyan coupler of the present invention. The amount of the colored coupler to be used is generally about 1 to 30 mol%, preferably 2 to 20 mol%, based on the molar amount of the cyan coupler. The colored coupler and cyan coupler of the present invention may be added to any layer selected from a low sensitivity layer, a high sensitivity layer, and the like. The colored coupler and cyan coupler of the present invention may also be added to a light-sensitive silver halide emulsion layer or its adjacent layers. The colored coupler of the present invention and the cyan coupler of the present invention may be mixed with each other and then added to the same layer or may be separately added to separate layers. These couplers of the present invention may be used in combination with other known couplers.

The incorporation of the present coupler into the light-sensitive material may be accomplished by any of various known dispersion processes such as solid dispersion process, alkali dispersion process, latex dispersion process and oil-in-water dispersion process. A preferred process among these is a latex dispersion process. A more preferred process is an oil-in-water dispersion process. In the oil-in-water dispersion process, the coupler of the present invention is dissolved in one or a mixture of a high boiling point organic solvent having a boiling point of 175° C. or above and a so-called low boiling point auxiliary solvent. The resulting solution is finely dispersed in water or an aqueous medium such as aqueous gelatin solution in the presence of a surface active agent. Examples of such a high boiling point organic solvent are described in U.S. Pat. No. 2,322,027. The dispersion process may involve phase inversion. The auxiliary solvent may be removed or diminished as necessary by distillation, noodle ringing, or ultrafiltration before the material is coated on a support.

Specific examples of such a high boiling point organic solvent include phthalic esters such as dibutyl phthalate, dicyclohexyl phthalate, di-2-ethylhexyl phthalate and decyl phthalate, phosphoric and phosphonic esters such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate, benzoic esters such as 2-ethylhexyl benzoate, dodecyl benzoate and 2-ethylhexyl-p-hydroxy benzoate, amides such as diethyl dodecane amide and N-tetradecyl pyrrolidone, alcohols and phenols such as isostearyl alcohol and 2,4-di-tertamylphenol, aliphatic carbonic esters such as dioctyl azelate, glycerol tributylate, isostearyl lactate and trioctyl citrate, aniline derivatives such as N,N-dibutyl-2-butoxy-5-tert-octylaniline, and hydrocarbons such as paraffin, dodecylbenzene, and diisopropylnaphthalene. As the auxiliary solvent there may be employed an organic solvent having a boiling point of about 30° C. or above, preferably about 50° C. to about 160° C. Typical examples of such an organic solvent include ethyl acetate, butyl acetate, ethyl propionate, methyl ethyl ketone, cyclohexanone, 2-ethoxyethyl acetate and dimethylformamide.

Specific examples of latex dispersion process, its effect, and latex for impregnation are described in U.S. Pat. No. 4,199,363 and West German patent application (OLS) Nos. 2,541,274 and 2,541,230.

In the present invention, various color couplers may be used in combination thereof. Color couplers which may be used in combination with others include pyrazolone and pyrazoloazole compounds and open chain and heterocyclic ketomethylene compounds. Specific examples of these magenta and yellow couplers which may be used in the present invention are described in the patents cited in *Research Disclosure* (RD) 17643 (December, 1978) (Article VII-D) and *Research Disclosure* 18717 (November, 1979).

The color couplers to be used in combination with the light-sensitive material of the present invention may preferably have ballast groups or be polymerized to exhibit diffusion resistivity. The use of a 2-equivalent coupler in which hydrogen atom at the coupling active position is replaced by coupling elimination groups rather than a 4 -equivalent coupler having hydrogen atom at the coupling active position can reduce the amount of silver to be coated. Couplers forming coloring dyes with proper diffusibility, noncoloring couplers, or DIR couplers which release a development inhibitor upon coupling reaction, or development accelerators may also be used.

Typical examples of yellow couplers which may be used in the present invention include oil protect type acylacetamide couplers. Specific examples of such couplers are described in U.S. Pat. Nos. 2,407,210, 2,875,057 and 3,265,506. In the present invention, 2-equivalent yellow couplers are preferably used. Typical examples of such 2-equivalent yellow couplers include oxygen atom-releasing yellow couplers described in U.S. Pat. Nos. 3,408,194, 3,447,928, 3,933,501 and 4,022,620, and nitrogen atom-releasing yellow couplers described in Japanese patent application No. 10739/83, U.S. Pat. Nos. 4,401,752 and 4,326,024, RD 18053 (April, 1979), British Pat. No. 1,425,020, West German patent application (OLS) Nos. 2,219,917, 2,261,361, 2,329,587 and 2,433,812. α-Pivaloyl acetanilide couplers are excellent with respect to fastness of developed dye, especially to light. On the other hand, α-benzoyl acetanilide couplers can provide a high color density.

As the magenta coupler which may be used in the present invention there may be employed oil protect type indazolone or cyanoacetyl, preferably 5-pyrazolone or pyrazoloazole couplers such as pyrazolotriazole. As the 5-pyrazolone coupler there may be preferably used a coupler in which the hydrogen atom at the 3-position is replaced by an aryl amino or acyl amino group to improve hue and color density. Typical examples of such a coupler are described in U.S. Pat. Nos. 2,311,082, 2,343,703, 2,600,788, 2,908,573, 3,062,653, 3,152,896 and 3,936,015. As the elimination group for the 2-equivalent 5-pyrazolone coupler there may be particularly preferably used nitrogen atom-releasing groups described in U.S. Pat. No. 4,310,619 or arylthio groups described in U.S. Pat. No. 4,351,897. 5-Pyrazolone couplers having ballast groups described in European Pat. No. 73,636 can provide a high color density.

Examples of the pyrazoloazole couplers of the present invention include pyrazolobenzimidazole described in U.S. Pat. No. 3,369,879, preferably pyrazolo[5,1-c][1,2,4]triazole described in U.S. Pat. No. 3,725,067, pyrazolotetrazole described in *Research Disclosure* 24220 (June, 1984) and Japanese patent application (OPI) No. 33552/85 (the term "OPI" as used herein refers to a "published unexamined Japanese patent application"), and pyrazoloazole described in *Research Disclosure* 24230 (June, 1984) and Japanese patent application (OPI) No. 43659/85. Imidazo[1,2-b]-pyrazole described in U.S. Pat. No. 4,500,630 is preferably used in that the developed dye has less yellow side absorption and good fastness to light. Pyrazolo[1,5-b][1,2,4]triazole described in European Pat. No. 119,860A is particularly preferred.

A coupler forming a coloring dye with a proper diffusibility may be used in combination with the present invention to improve graininess. Specific examples of such a magenta coupler are described in U.S. Pat. No. 4,366,237 and British Pat. No. 2,125,570. Specific examples of such yellow, magenta and cyan couplers are described in European Pat. No. 96,570 and West German patent application (OLS) No. 3,234,533.

The dye-forming couplers of the present invention and the above special couplers may form dimers or higher polymers. Typical examples of dye-forming couplers thus polymerized are described in U.S. Pat. Nos. 3,451,820 and 4,080,211. Specific examples of polymerized magenta couplers are described in British Pat. No. 2,102,173 and U.S. Pat. No. 4,367,282.

In order to meet the properties required for the light-sensitive material, these various couplers of the present invention may be used in combination in the same layer in a light-sensitive layer or may be used singly in two or more different layers.

The preparation of silver halide photographic emulsions which may be used in the present invention may be accomplished by any known process as described in *Research Disclosure* (RD) No. 17643 (December, 1978) (pp. 22–23) "I. Emulsion Preparation and Types" and *Research Disclosure* No. 18716 (November, 1979) (pp. 648). Tabular particles as described in U.S. Pat. Nos. 4,434,226 and 4,439,520 and *Research Disclosure* No. 22534 (January, 1983) may also be used in the present invention. Monodispersed emulsions having a narrow distribution of size of dispersed particles or a polydispersed emulsion having a wide distribution of size of dispersed particles may be used.

Various photographic additives which may be used in the present invention are described in, for example, *Research Disclosure* No. 17643 (pp. 23–28) and *Research Disclosure* No. 18716 (pp. 648–651). The type of these additives and the detailed places where they are described are shown below:

| | Type and Additives | RD 17643 | RD 18716 |
|---|---|---|---|
| 1. | Chemical sensitizer | p. 23 | Right column on p. 648 |
| 2. | Sensitizer | | " |
| 3. | Spectral sensitizer Supersensitizer | p. 23–24 | Right column on p. 648 to right column on p. 649 |
| 4. | Fog inhibitor and stabilizer | p. 24–25 | Right column on p. 649 |
| 5. | Light absorber, filter dye, ultraviolet absorber | p. 25–26 | Right column on p. 649 to right column on p. 650 |
| 6. | Stain inhibitor | Right column on p. 25 | Right and left columns on p. 650 |
| 7. | Hardener | p. 26 | Left column on p. 651 |
| 8. | Binder | p. 26 | " |
| 9. | Plasticizer, lubricant | p. 27 | Right column on p. 650 |
| 10. | Coating aid, surface active agent | p. 26–27 | Right column on p. 650 |
| 11. | Antistatic agent | p. 27 | " |

Examples of suitable supports which may be used in the present invention are described in RD No. 17643 (p. 28) and RD No. 18716 (right column on p. 647 to left column on p. 648).

The color photographic material prepared in accordance with the present invention may be developed by any ordinary process as described in RD No. 17643 (pp. 28–29) and RD No. 18716 (left column to right column on p. 651).

Once subjected to development, blix or fixing, the color photographic material of the present invention is subjected to an ordinary rinsing or stabilization.

The rinsing process is generally conducted by a rinsing system comprising two or more counterflow tanks to save water. The stabilization process can be accomplished by the multistage counterflow stabilization process as described in Japanese patent application (OPI) No. 8543/82 rather than by a rinsing process. The multistage counterflow stabilization process requires 2 to 9 counterflow baths. Various compounds are added to the stabilization bath for the purpose of stabilizing developed images. For example, various buffering agents for adjusting the pH of films to, for example, 3 to 8, such as borate, metaborate, borax, phosphate, carbonate, potassium hydroxide, sodium hydroxide, ammonium water, monocarboxylic acid, dicarboxylic acid, and polycarboxylic acid in combination, and formalin may be used. In addition, water softener such as inorganic phosphoric acid, aminopolycarboxylic acid, organic phosphoric acid, aminopolyphosphonic acid, and phosphonocarboxylic acid, germicide such as benzoisothiazolinone, irithiazolone, 4-thiazolinebenzimidazole, and halogenated phenol, surface active agent, brightening agent, hardener, and other additives may be used as necessary. These compounds may be used in combination with compounds of the same or different type.

As the film pH adjusting agent to be used after treatment there may be preferably employed various ammonium salts such as ammonium nitrate, ammonium sulfate, ammonium phosphate, ammonium sulfite, ammonium thiosulfate.

The present invention may be applied to various color light-sensitive materials. Typical examples of such color light-sensitive materials include general purpose and motion picture color negative films, color reversal films for use in slide projection and television broadcast, color papers, color positive films, and color reversal papers. The present invention may also be applied to a black-and-white light-sensitive materials utilizing a mixture of three color couplers as described in *Research Disclosure* No. 17123 (July, 1978).

In the preferred embodiment of the present invention, a silver halide color photographic material comprises a blue-sensitive silver halide emulsion layer, a green-sensitive silver halide emulsion layer and a red-sensitive silver halide emulsion layer on a support, wherein the red-sensitive silver halide emulsion layer comprises at least one of the colored couplers represented by the aforementioned general formula (I) and, wherein the red-sensitive silver halide emulsion layer comprises two or more unit layers having different sensitivities, and of the unit layers, at least one of the unit layers other than the unit layer lowest in sensitivity comprises at least one cyan coupler selected from the following group (A) and the unit layer lowest in sensitivity comprises at least one cyan coupler selected from the following group (B):

(A) cyan couplers represented by the aforementioned general formula (II) wherein Y represents an aryloxy group, cyan couplers represented by the aforementioned general formula (III) wherein $R_5$ represents an aryl group, cyan couplers represented by the aforementioned general formula (IV) wherein Y represents an aryloxy group or an alkoxy group and cyan couplers represented by the aforementioned general formula (V) wherein Y represents an aryloxy group or an alkoxy group; and (B) cyan couplers represented by the aforementioned general formula (II), (IV) or (V) wherein Y represents a hydrogen atom.

The present invention will be further illustrated in the following examples, but the present invention should not be construed as being limited thereto.

EXAMPLE 1

Specimen 101 was prepared by applying the following compositions on a cellulose triacetate film support so that a multilayer color light-sensitive material was formed.

| | |
|---|---|
| First Layer: Antihalation Layer | |
| A gelatin layer containing: | |
| Black colloidal silver | 0.18 g/m$^2$ |
| Ultraviolet Absorber C-1* | 0.16 g/m$^2$ |
| Ultraviolet Aborber C-2 | 0.77 g/m$^2$ |
| Second Layer: Intermediate Layer | |
| A gelatin layer containing: | |
| Compound H-1 | 0.18 g/m$^2$ |
| Silver iodobromide emulsion (silver iodide: 1 mol %, average particle size: 0.07 μm) | 0.15 g/m$^2$ |
| (in terms of the amount of silver coated, similarly hereinafter) | |

-continued

| | |
|---|---|
| Third Layer: First Red-Sensitive Emulsion Layer | |
| A gelatin layer containing: | |
| Silver iodobromide emulsion (silver iodide: 6 mol %, average particle size: 0.5 μm) | 0.72 g/m$^2$ |
| Sensitizing Dye I | 7.0 × 10$^{-5}$ mol per mol of silver |
| Sensitizing Dye II | 2.0 × 10$^{-5}$ mol per mol of silver |
| Sensitizing Dye III | 2.8 × 10$^{-4}$ mol per mol of silver |
| Sensitizing Dye IV | 2.0 × 10$^{-5}$ mol per mol of silver |
| Coupler C-3 | 0.40 g/m$^2$ |
| Coupler C-4 | 0.01 g/m$^2$ |
| Coupler C-5 | 0.04 g/m$^2$ |
| Fourth Layer: Second Red-Sensitive Emulsion Layer | |
| A gelatin layer containing: | |
| Silver iodobromide emulsion (silver iodide: 10 mol %, average particle size: 1.2 μm) | 1.2 g/m$^2$ |
| Sensitizing Dye I | 5.2 × 10$^{-5}$ mol per mol of silver |
| Sensitizing Dye II | 1.5 × 10$^{-5}$ mol per mol of silver |
| Sensitizing Dye III | 2.1 × 10$^{-4}$ mol per mol of silver |
| Sensitizing Dye IV | 1.5 × 10$^{-5}$ mol per mol of silver |
| Coupler C-6 | 0.23 g/m$^2$ |
| Coupler C-4 | 0.01 g/m$^2$ |
| Coupler C-5 | 0.04 g/m$^2$ |
| Fifth Layer: Third Red-Sensitive Emulsion Layer | |
| A gelatin layer containing: | |
| Silver iodobromide emulsion (silver iodide: 10 mol %, average particle size: 1.8 μm) | 2.0 g/m$^2$ |
| Sensitizing Dye I | 5.5 × 10$^{-5}$ mol per mol of silver |
| Sensitizing Dye II | 1.6 × 10$^{-5}$ mol per mol of silver |
| Sensitizing Dye III | 2.2 × 10$^{-5}$ mol per mol of silver |
| Sensitizing Dye IV | 1.6 × 10$^{-5}$ mol per mol of silver |
| Coupler C-6 | 0.10 g/m$^2$ |
| Coupler C-7 | 0.08 g/m$^2$ |
| Sixth Layer: Intermediate Layer | |
| A gelatin layer containing: | |
| Compound H-1 | 0.02 g/m$^2$ |
| Seventh Layer: First Green-Sensitive Emulsion Layer | |
| A gelatin layer containing: | |
| Silver iodobromide emulsion (silver iodide: 5 mol %, average particle size: 0.4 μm) | 0.55 g/m$^2$ |
| Sensitizing Dye V | 3.8 × 10$^{-4}$ mol per mol of silver |
| Sensitizing Dye VI | 3.0 × 10$^{-5}$ mol per mol of silver |
| Coupler C-8 | 0.29 g/m$^2$ |
| Coupler C-9 | 0.04 g/m$^2$ |
| Coupler C-10 | 0.04 g/m$^2$ |
| Coupler C-4 | 0.01 g/m$^2$ |
| Eighth Layer: Second Green-Sensitive Emulsion Layer | |
| A gelatin layer containing: | |
| Silver iodobromide emulsion (silver iodide: 10 mol %, average particle size: 1.2 μm) | 1.0 g/m$^2$ |
| Sensitizing Dye V | 2.7 × 10$^{-4}$ mol per mol of silver |
| Sensitizing Dye VI | 2.1 × 10$^{-5}$ mol per mol of silver |
| Coupler C-11 | 0.04 g/m$^2$ |
| Coupler C-4 | 0.002 g/m$^2$ |
| Coupler C-12 | 0.01 g/m$^2$ |
| Coupler C-10 | 0.005 g/m$^2$ |
| Ninth Layer: Third Green-Sensitive Emulsion Layer | |
| A gelatin layer containing: | |
| Silver iodobromide emulsion (silver iodide: 10 mol %, average particle size: 1.8 μm) | |

-continued

| | |
|---|---|
| | 1.5 g/m$^2$ |
| Sensitizing Dye V | 3.0 × 10$^{-4}$ mol per mol of silver |
| Sensitizing Dye VI | 2.4 × 10$^{-5}$ mol per mol of silver |
| Coupler C-11 | 0.03 g/m$^2$ |
| Coupler C-10 | 0.005 g/m$^2$ |
| Tenth Layer: Yellow Filter Layer | |
| A gelatin layer containing: | |
| Yellow colloidal silver | 0.04 g/m$^2$ |
| Coupler C-9 | 0.10 g/m$^2$ |
| Compound H-1 | 0.20 g/m$^2$ |
| Eleventh Layer: First Blue-Sensitive Emulsion Layer | |
| A gelatin layer containing: | |
| Silver iodobromide emulsion (silver iodide: 5 mol %, average particle size: 0.3 μm) | 0.32 g/m$^2$ |
| Coupler C-13 | 0.68 g/m$^2$ |
| Coupler C-4 | 0.03 g/m$^2$ |
| Twelfth Layer: Second Blue-Sensitive Emulsion Layer | |
| A gelatin layer containing: | |
| Silver iodobromide emulsion (silver iodide: 10 mol %, average particle size: 0.8 μm) | 0.29 g/m$^2$ |

-continued

| | |
|---|---|
| Coupler C-13 | 0.22 g/m$^2$ |
| Thirteenth Layer: Third Blue-Sensitive Emulsion Layer | |
| A gelatin layer containing: | |
| Silver iodobromide emulsion (silver iodide: 14 mol %, average particle size: 1.8 μm) | 0.79 g/m$^2$ |
| Sensitizing Dye VII | 2.3 × 10$^{-4}$ mol per mol of silver |
| Coupler C-13 | 0.19 g/m$^2$ |
| Fourteenth Layer: First Protective Layer | |
| A gelatin layer containing: | |
| Ultraviolet Absorber C-1 | 0.20 g/m$^2$ |
| Ultraviolet Absorber C-2 | 0.90 g/m$^2$ |
| Fifteenth Layer: Second Protective Layer | |
| A gelatin layer containing: | |
| Particulate polymethyl methacrylate (particle diameter: 1.5 μm) | 0.05 g/m$^2$ |

*The specific compounds referenced in layers used on the preparation of Specim 101 are shown below.

In addition to the above compositions, a Gelatin Hardener C-14 and a surface active agent were added to each layer. Thus, Specimen 101 was prepared.

C-1

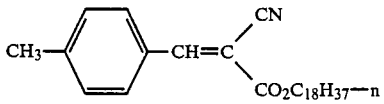

C-2

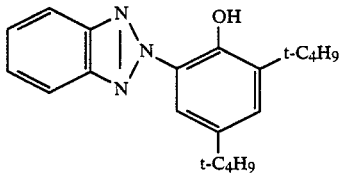

C-3

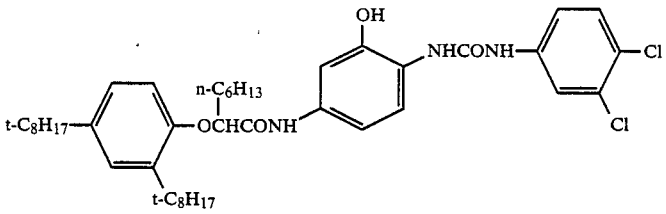

C-4

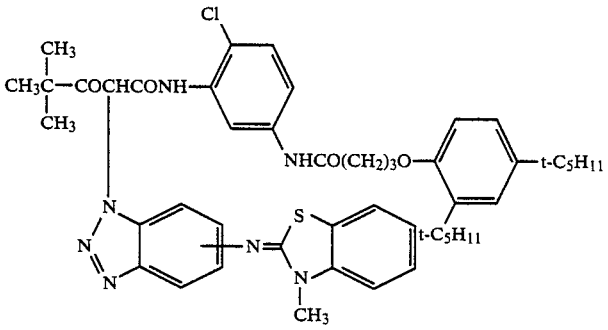

-continued
C-5
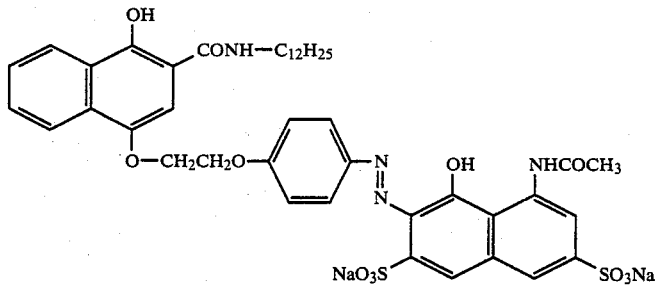
C-6
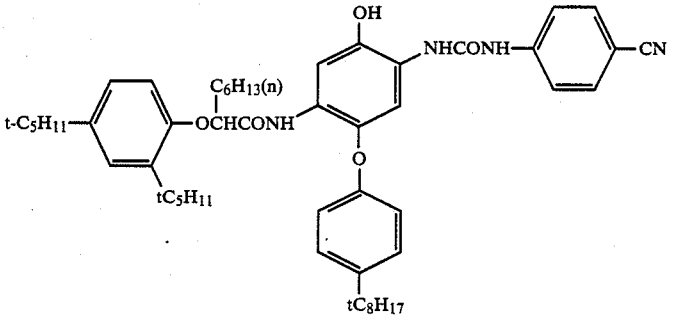
C-7
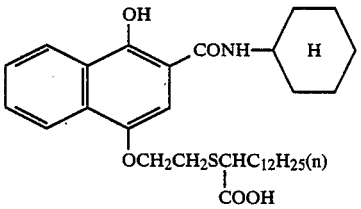
C-8
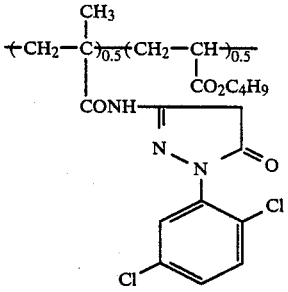
C-9
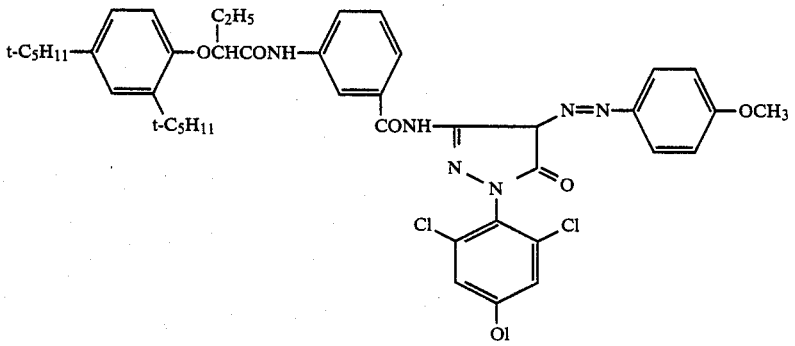

-continued
C-10
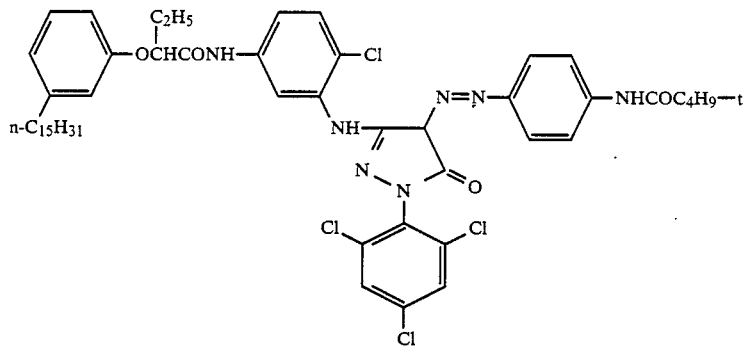
C-11
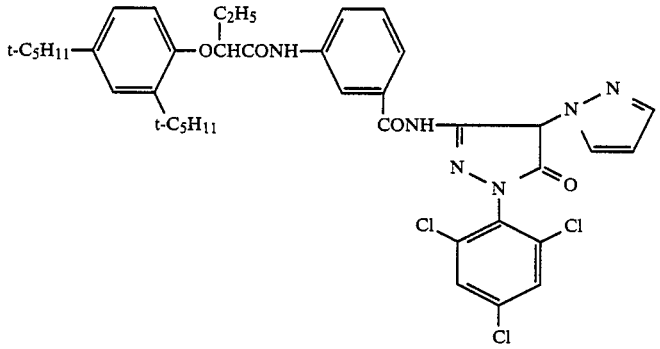
C-12
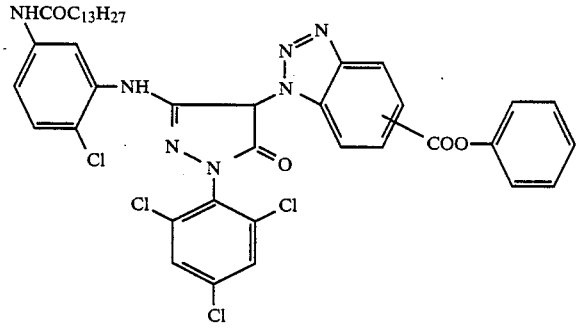
C-13
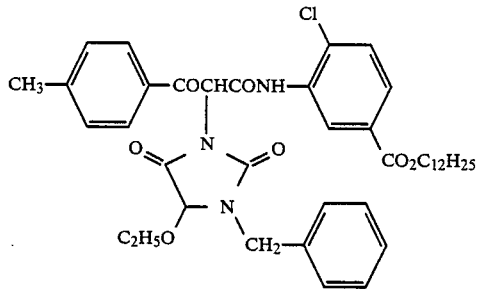
C-14
$(CH_2{=}CHSO_2CH_2CONHCH_2)_2$
H-1
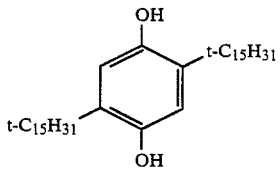

-continued

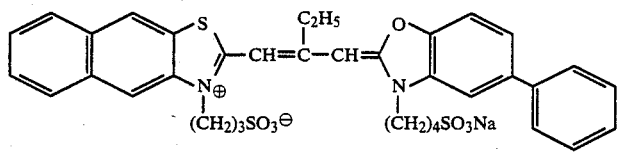

Sensitizing Dye I

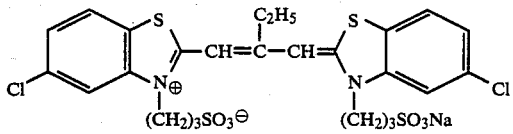

Sensitizing Dye II

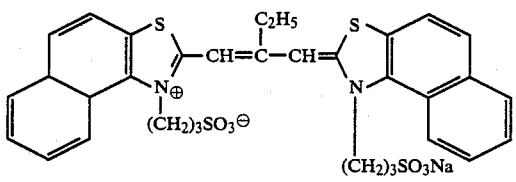

Sensitizing III

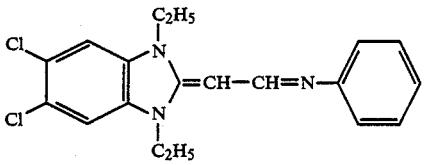

Sensitizing Dye IV

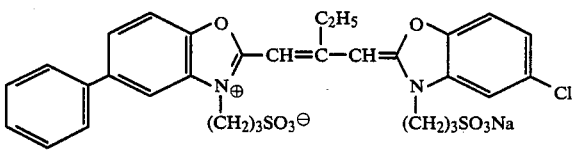

Sensitizing Dye V

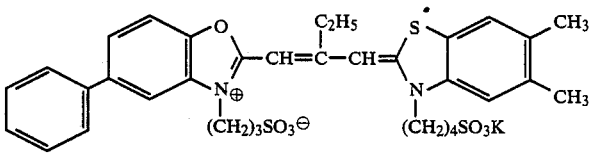

Sensitizing Dye VI

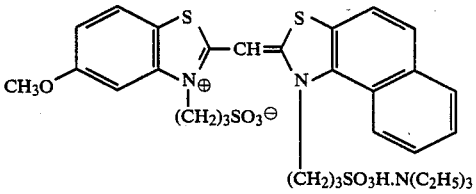

Sensitizing Dye VII

Specimens 102 to 115 were prepared in the same manner as used in Specimen 101 except that the couplers in the red-sensitive emulsion layers were replaced by those shown in Table 1.

In Table 1, the same molar equivalent of couplers are used.

The structural formulae of the couplers used in Comparative Examples (described in U.S. Pat. No. 4,458,012) are as follows:

C-15

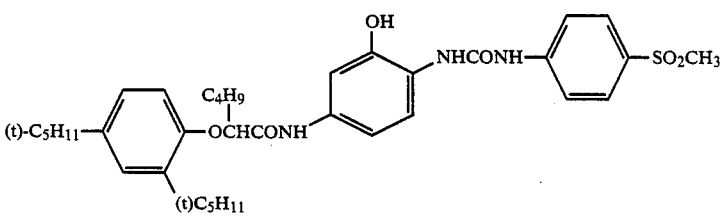

-continued

C-16

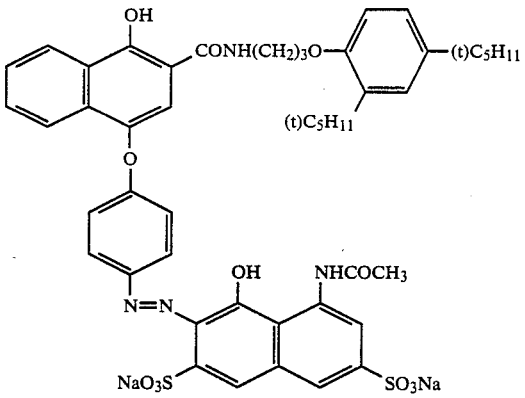

C-17

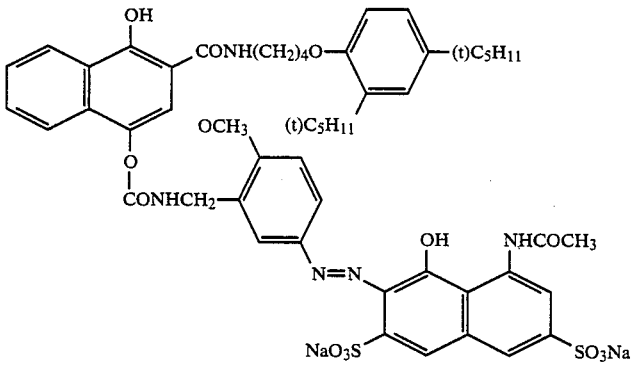

TABLE 1

| Specimen No. | Colored Cyan Coupler in 1st or 2nd Red-Sensitive Emulsion Layer | Cyan Coupler* 1st Red-Sensitive Emulsion Layer | 2nd Red-Sensitive Emulsion Layer | 3rd Red-Sensitive Emulsion Layer |
|---|---|---|---|---|
| 101 (comparison) | C-5 | C-3 | C-6 | C-6 + C-7 [C-6/C-7 = 6/7] |
| 102 (comparison) | C-16 | C-15 | C-15 | C-15 |
| 103 (comparison) | C-17 | C-6 | C-6 | C-6 |
| 104 (comparison) | C-5 | C-3 | C-6 | IV-(5) |
| 105 (Invention) | I-(1) | C-3 | C-6 | C-6 + C-7 [C-6/C-7 = 6/7] |
| 106 (Invention) | I-(1) | C-6 | C-6 | C-6 |
| 107 (Invention) | I-(1) | II-(1) + II-(10) [II-(1)/II-(10) = 7/3] | II-(1) + II-(10) [II-(1)/II-(10) = 7/3] | C-6 |
| 108 (Invention) | I-(2) | II-(10) | II-(10) | III-(1) |
| 109 (Invention) | I-(3) | C-3 | C-6 | IV-(5) |
| 110 (Invention) | I-(4) | C-6 | C-6 | C-6 |
| 111 (Invention) | I-(4) | V-(5) | V-(5) | C-6 + C-7 [C-6/C-7 = 6/7] |
| 112 (Invention) | I-(5) | V-(3) + V-(6) [V-(3)/V-(6) = 1/1] | V-(3) + V-(6) [V-(3)/V-(6) = 1/1] | III-(11) + IV-(1) [III-(11)/IV-(1) = 1/1] |
| 113 (Invention) | I-(6) | V-(18) | V-(18) | IV-(16) |
| 114 (Invention) | I-(7) | II-(1) + II-(10) [II-(1)/II-(10) = 7/3] | II-(1) + II-(10) [II-(1)/II-(10) = 7/3] | II-(1) + II-(10) [II-(1)/II-(10) = 7/3] |
| 115 (Invention) | I-(7) | IV-(21) | III-(15) | III-(15) |

*The number in brackets indicates molar ratio in the mixture.

The specimens thus obtained were subjected to wedgewise light exposure, and then to color development.

| | Development Process (A) Treatment | Temperature (° C.) | Time |
|---|---|---|---|
| 1. | Pretreatment bath | 27 ± 1 | 10 sec |
| 2. | Backing removal and | 27–38 | 5 sec |

-continued

| | Development Process (A) Treatment | Temperature (° C.) | Time |
|---|---|---|---|
| | spray rinsing | | |
| 3. | Color development | 41.1 ± 0.1 | 3 min |
| 4. | Stop bath | 27–38 | 30 sec |
| 5. | Rinsing | 27–38 | 30 sec |
| 6. | Bleaching | 38 ± 1 | 3 min |
| 7. | Rinsing | 27–38 | 1 min |

-continued

| Development Process (A) | | | |
|---|---|---|---|
| | Treatment | Temperature (° C.) | Time |
| 8. | Fixing | 38 ± 1 | 2 min |
| 9. | Rinsing | 27–38 | 2 min |
| 10. | Stabilization | 27–38 | 10 sec |

The preparation of the treatement solutions used in the above steps are as follows:

| | |
|---|---|
| Pretreatment Bath | |
| Water (27–38° C.) | 800 ml |
| Borax (decahydrate) | 20.0 g |
| Sodium sulfate (anhydrous) | 100 g |
| Sodium hydroxide | 1.0 g |
| Water to make | 1.00 l |
| Color Development | |
| Water (21–38° C.) | 850 ml |
| Kodak Anticalcium No. 4: 40 wt % aqueous solution of the compound of the following formula: | 2.0 ml |
| $N(CH_2PO_3Na_2)_2$ \| $CH_2PO_3HNa$ | |
| Sodium sulfite (anhydrous) | 2.0 g |
| Kodak Antifog No. 9: 3,5-di-nitrobenzoic acid | 0.22 g |
| Sodium bromide (anhydrous) | 1.20 g |
| Sodium carbonate (anhydrous) | 25.6 g |
| Sodium bicarbonate | 2.7 g |
| Color developing agent: 4-(N—ethyl-N—β-methanesulfonamidoethyl)-m-toluidine | 4.0 g |
| Water to make | 1.00 l |
| pH (27° C.) | 10.20 |
| Stop Bath | |
| Water (21–38° C.) | 900 ml |
| 7.0 N Sulfuric acid | 50 ml |
| Water to make | 1.00 l |
| pH (27° C.) | 0.9 |
| Bleaching | |
| Water (32–43° C.) | 900 ml |
| Potassium ferricyanide | 40.0 g |
| Sodium bromide (anhydrous) | 25.0 g |
| Water to make | 1.00 l |
| pH (27° C.) | 6.0 |
| Fixing | |
| Water (20–38° C.) | 700 ml |
| Kodak Anticalcium No. 4 | 2.0 ml |
| 58% Ammonium thiosulfate solution | 185 ml |
| Sodium sulfite (anhydrous) | 10.0 g |
| Sodium bisulfite (anhydrous) | 8.4 g |
| Water to make | 1.00 l |
| pH (27° C.) | 6.5 |
| Stabilization | |
| Water (21–27° C.) | 1.00 l |
| Kodak Stabilizer Additive | 0.14 ml |
| Formalin (37.5% solution) | 1.50 ml |

Development Process (B) was conducted in the same manner as used in Development Process (A) except that the rinsing process 5 in Development Process (A) was replaced by a 30 sec bleaching acceleration process at 27° C. using a bleaching acceleration bath described below (hereinafter referred to as "process 5'") and the bleaching process 6 in Development Process (A) was replaced by a 3 min bleaching process at 27° C. using a persulfuric acid bleaching bath described below.

| | |
|---|---|
| Bleaching Acceleration Bath Used in Process 5' | |
| Water | 900 ml |
| Sodium metabisulfite (anhydrous) | 10.0 g |

-continued

| | |
|---|---|
| Glacial acetic acid | 25.0 ml |
| Sodium acetate | 10.0 g |
| EDTA-4Na | 0.7 g |
| PBA-1 | 5.5 g |
| Water to make | 1.0 l |
| pH (27° C.) | 3.8 ± 0.2 |
| (PBA-1 represents 2-dimethylaminoethyl isothiourea dichloride.) | |
| Persulfuric Acid Bleaching Bath Used in Process 6' | |
| Water (24–38° C.) | 800 ml |
| Gelatin | 0.5 g |
| Sodium persulfate | 30 g |
| Sodium chloride | 15.0 g |
| Monobasic sodium phosphate (anhydrous) | 9.0 g |
| Phosphoric acid (85 wt %) | 2.5 ml |
| Water to make | 1.0 l |
| pH (27° C.) | 2.3 ± 0.2 |

The results of the development tests are shown in Table 2.

TABLE 2

| Specimen No. | $D_B$* | $D_{B/1.5} \times 100$ (%) |
|---|---|---|
| 101 (Comparative Example) | 1.23 | 82 |
| 102 (Comparative Example) | 1.19 | 79 |
| 103 (Comparative Example) | 1.30 | 87 |
| 104 (Comparative Example) | 1.24 | 83 |
| 105 (Present Invention) | 1.48 | 99 |
| 106 (Present Invention) | 1.50 | 100 |
| 107 (Present Invention) | 1.50 | 100 |
| 108 (Present Invention) | 1.50 | 100 |
| 109 (Present Invention) | 1.49 | 99 |
| 110 (Present Invention) | 1.50 | 100 |
| 111 (Present Invention) | 1.48 | 99 |
| 112 (Present Invention) | 1.49 | 99 |
| 113 (Present Invention) | 1.50 | 100 |
| 114 (Present Invention) 1.50 | 100 | |
| 115 (Present Invention) | 1.48 | 99 |

*$D_B$: Density obtained by Development Process (B) using an exposure which provides a density of 1.5 in Development Process (A).

Table 2 shows that the specimens of the present invention provide a small decrease in the density of cyan color image even when treated with a bleaching bath having a weak oxidizing power.

EXAMPLE 2

Specimens 101, 103, 106 and 107 obtained in Example 1 were subjected to light exposure in the same manner as used in Example 1, and then to the following Development Process (C) at a temperature of 38° C.

| | |
|---|---|
| 1. Color development | 3 min 15 sec |
| 2. Bleaching | 6 min 30 sec |
| 3. Rinsing | 3 min 15 sec |
| 4. Fixing | 6 min 30 sec |
| 5. Rinsing | 3 min 15 sec |
| 6. Stabilization | 3 min 15 sec |

The preparation of the treatment compositions used in the above steps are as follows:

| | |
|---|---|
| Color Developing Agent | |
| Sodium nitrilotetraacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1.0 l |
| Bleaching Bath | |

-continued

| | |
|---|---|
| Ammonium bromide | 160.0 g |
| Ammonia water (28%) | 25.0 ml |
| Sodium ethylenediaminetetraacetato ferrate | 130.0 g |
| Glacial acetic acid | 14.0 ml |
| Water to make | 1.0 l |
| Fixing Bath | |
| Sodium tetrapolyphosphate | 2.0 g |
| Sodium sulfite | 4.0 g |
| Ammonium thiosulfate (70%) | 175.0 ml |
| Sodium biphosphite | 4.6 g |
| Water to make | 1.0 l |
| Stabilizing Bath | |
| Formalin | 8.0 ml |
| Water to make | 1.0 l |

Development Process (D) was then conducted in the same manner as used in Development Process (C) except that that the bleaching bath in Development Process (C) was replaced by the following bleaching composition. The bleaching bath simulated the state of being exhausted after treatment of a large amount of light-sensitive materials.

| Development Process (D) Bleaching Composition | |
|---|---|
| (D-1) | |
| Ammonium bromide | 160.0 g |
| Ammonia water (29%) | 7.1 ml |
| Sodium ethylenediaminetetraacetato ferrate | 117 g |
| Glacial acetic acid | 14 ml |
| Water to make | 900 ml |
| (D-2) | |
| Sodium ethylenediaminetetraacetato ferrate | 130 g |
| Water to make | 1.0 l |

Development Process (D)'s bleaching bath was obtained by adding to (D-1) 100 ml of Fe(II)-EDTA solution wherein Fe(II)-EDTA which had been reduced from Fe(III)-EDTA by putting steel wool into (D-2) and then allowing it to stand with the container sealed.

Specimens 101, 103, 106 and 107, which had been subjected to Development Processes (C) and (D), were then measured for sensitometry. The density of cyan color developed in Development Process (D) using an exposure which provides a cyan color density of 1.5 in Development Process (C) was measured. The value thus obtained was divided by 1.5 and then multiplied by 100. The results are shown in Table 3.

TABLE 3

| | Specimen | | | |
|---|---|---|---|---|
| | 101 | 103 | 106 | 107 |
| Relative cyan color density | 81 | 80 | 100 | 100 |

Specimens 106 and 107 of the present invention show no decrease in cyan color density whereas the comparitive specimens 101 and 103 show remarkable decrease in cyan color density due to the exhausted bleaching bath.

EXAMPLE 3

In order to examine the color image stability of the specimens obtained in Example 1, the specimens which had been developed were stored at a temperature of 60° C. and a relative humidity of 70% for 2 months, and then examined for changes in cyan color image density. The results are shown in Table 4. The comparitive specimens were stored at a temperature of 0° C.

TABLE 4

| Specimen No. | Dt/Do (%) |
|---|---|
| 103 (Comparative Example) | 79 |
| 104 (Comparative Example) | 76 |
| 110 (Present Invention) | 92 |
| 111 (Present Invention) | 95 |
| 112 (Present Invention) | 90 |

$$Dt/Do = \frac{\text{Density after storage (initial density Do = 1.5)}}{\text{Density of comparative specimen stored at 0° C.}} \times 100$$

The specimens of the present invention show less decrease in cyan image density after being stored, thus providing excellent results.

As apparent from the foregoing description, the present invention can be accomplished by the combined use of at least one colored coupler represented by the general formula (I) and at least one cyan coupler represented by the general formula (II), (III), (IV) or (V) in a silver halide photographic material. In other words, the silver halide color photographic material of the present invention can provide a high sensitivity for cyan image even when treated with a bleaching bath having a weak oxidizing power or exhausted bleaching bath. Furthermore, the silver halide color photographic material of the present invention shows improved cyan image fastness and color reproductivity. The couplers represented by the general formulae (II), (III), (IV) and (V) are excellent in color development because they contain 4-cyanophenyl ureido groups, $R_5$, $R_1$, and XH, respectively. The colored couplers to be used in combination with these cyan couplers must be excellent in color development to provide a uniform masking effect. The coupler represented by the general formula (I) shows such an excellent effect. It cannot be said that such combination of couplers are specifically described in U.S. Pat. No. 4,458,012 and other known literature. Thus, the present invention provides an ideal technique for the combined use of colored couplers and cyan couplers.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a blue-sensitive silver halide emulsion layer, a green-sensitive silver halide emulsion layer, a red-sensitive silver halide emulsion layer on a support and at least one of the color couplers represented by the general formula (I) and at least one of the cyan couplers represented by the general formulae (IV) and (V)

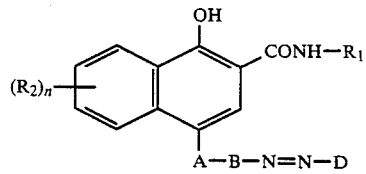

(I)

-continued

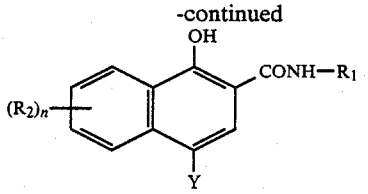

(IV)

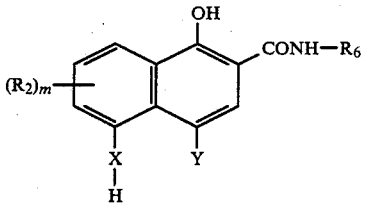

(V)

wherein $R_1$ represents an aromatic or heterocyclic group; $R_2$ represents a group capable of being substituted on a naphthol ring; $R_6$ represents an aliphatic group; n represents an integer of 0 to 4; m represens an integer of 0 to 3; A-B-N=N-D represents a group which is eliminated upon coupling; A represents a divalent group whose bond to the carbon atom at the coupling active position of the coupler is cleaved upon the reaction with an oxidation product of a color developing agent; B represents a divalent aromatic or heterocyclic group; D represents an aromatic or heterocyclic group; Y represents a hydrogen atom or a group which is eliminated upon coupling; X represents —O—, —S— or

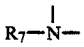

in which $R_7$ represents a hydrogen atom or an organic substituent group, with the proviso that when n and m are other than 0, $R_2$ may be the same as or different from each other or may be bonded to each other to form a ring; $R_2$ and X or X and Y in the general formula (V) may be bonded to each other to form a ring; $R_1$, $R_2$, $R_6$, $R_7$, X or Y may form a dimer or higher polymer; and at least one of the groups represented by A, B and D in the general formula (I) has a sulfo group, a carboxyl group, or an alkali metal or an ammonium salt thereof as a substituent group, wherein said red-sensitive silver halide emulsion layer contains at least one of the colored couplers represented by the general formula (I) and wherein the red-sensitive silver halide emulsion layer comprises two or more unit layers having different sensitivities, and of the unit layers, at least one of the unit layers other than the unit layer lowest in sensitivity comprises at least one cyan coupler selected from the following group (A) and the unit layer lowest in sensitivity comprises at least one cyan coupler selected from the following group (B):

(A) cyan couplers represented by the general formula (IV) wherein Y represents an aryloxy group or an alkoxy group and cyan couplers represented by the general formula (V) wherein Y represents an aryloxy group or an alkoxy group; and (B) cyan couplers represented by the general formula (IV) or (V) wherein Y represents a hydrogen atom.

2. The silver halide color photographic material as claimed in claim 1, wherein the aromatic group represented by $R_1$, is selected from the group consisting of substituted and unsubstituted aromatic groups having $C_{6-30}$ aromatic residual groups.

3. The silver halide color photographic material as claimed in claim 1, wherein the aliphatic group represented by $R_6$ is selected from the group consisting of substituted and unsubstituted aliphatic groups having $C_{1-30}$ aliphatic residual groups.

4. The silver halide color photographic material as claimed in claim 1, wherein the heterocyclic group represented by $R_1$, is selected from the group consisting of substituted and unsubstituted heterocyclic groups having $C_{2-30}$ heterocyclic residual groups.

5. The silver halide color photographic material as claimed in claim 1, wherein $R_2$ is a $C_{0-30}$ group capable of being substituted on a naphthol ring and is selected from the group consisting of a halogen atom, a hydroxy group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, and an imido group.

6. The silver halide color photographic material as claimed in claim 1, wherein the group represented by $R_7$ is a monovalent group represented by the general formula:

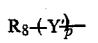

wherein Y' represents —CO— or —$SO_2$—; p represents 0 or 1; and $R_8$ represents a hydrogen atom, a $C_{1-30}$ aliphatic group, a $C_{6-30}$ aromatic group, a $C_{2-30}$ heterocyclic group, —OH, —$OR_9$, —$COR_9$, —$SO_2R_9$, or

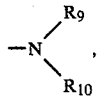

with the proviso that $R_9$ and $R_{10}$ each represents a hydrogen atom or group having the same meaning as defined in $R_3$ and that $R_9$ and $R_{10}$ may be the same as or different from each other in

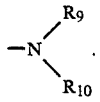

7. The silver halide color photographic material as claimed in claim 1, wherein the group represented by Y is selected from the group consisting of a halogen atom, —$OR_{11}$, —$SR_{11}$,

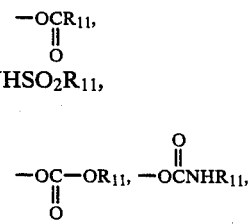

and a $C_{1-30}$ heterocyclic group which is connected to the coupling active position of the coupler by a nitrogen atom and $R_{11}$ represents a $C_{1-30}$ aliphatic group, a $C_{6-30}$ aromatic group or a $C_{2-30}$ heterocyclic group.

8. The silver halide color photographic material as claimed in claim 1, wherein A is a divalent group selected from the groups represented by Y, excluding halogen atoms, which is connected to B at the substitutable position of $R_{11}$ or is a divalent group selected from the groups represented by Y which is connected to B, excluding $R_{11}$.

9. The silver halide color photographic material as claimed in claim 1, wherein B is a $C_{6-20}$ divalent aromatic group or a $C_{2-20}$ divalent heterocyclic group.

10. The silver halide color photographic material as claimed in claim 1, wherein D is a $C_{6-20}$ aromatic group or a $C_{2-20}$ heterocyclic group.

11. The silver halide color photographic material as claimed in claim 1, wherein the colored coupler is present in an amount from about 1 to 30 mol % based on the amount of the cyan coupler.

12. The silver halide color photographic material as claimed in claim 11, wherein the colored coupler is present in an amount from 2 to 20 mol % based on the amount of the cyan coupler.

13. The silver halide color photographic material as claimed in claim 1, wherein Y represents a hydrogen atom, a halogen atom, $—OR_{11}$ or $—SR_{11}$, wherein $R_{11}$ represents a $C_{1-30}$ aliphatic group, a $C_{6-30}$ aromatic group or a $C_{2-30}$ heterocyclic group.

14. The silver halide color photographic material as claimed in claim 13, wherein Y represents a hydrogen atom, a chlorine atom, an aliphatic oxy group, an aromatic oxy group or a heterocyclic thio group.

15. The silver halide color photographic material as claimed in claim 1, wherein A is a group represented by the formula $—S\text{-}(A'\text{-}(Z)_l)_q$ or $—O\text{-}(A'\text{-}(Z)_l)_q$ wherein A' represents a $C_{1-6}$ divalent aliphatic group; Z represents —O—, —S—, —COO—, —CO—, —CONH—, $—SO_2NH—$, $—SO_2—$, or —NHCONH—; l represents an integer of 0 or 1; and q represents an ingeger of 0 to 2, with the proviso that when q represents an integer of 2, A', Z and l may be the same as or different from each other.

16. The silver halide color photographic material as claimed in claim 15, wherein A represents —O— or —S—.

17. The silver halide color photographic material as claimed in claim 1, wherein $R_1$ represents a substituted or unsubstituted phenyl group.

18. The silver halide color photographic material as claimed in claim 1, wherein n and m each represents 0.

19. The silver halide color photographic material as claimed in claim 1, wherein D represents a group represented by the following formula (VIIA):

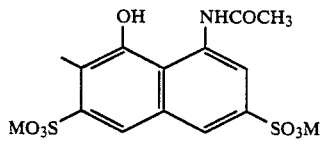

(VIIA)

wherein M represents an alkali metal ion or a hydrogen atom.

20. The silver halide color photographic material as claimed in claim 7, wherein said $C_{1-30}$ heterocyclic group is a succinic acid imido group, a phthalimido group, a hydantoinyl group, a pyrazolyl group, or a 2-benzotriazolyl group.

* * * * *